US005991570A

United States Patent [19]

Haga et al.

[11] Patent Number: 5,991,570

[45] Date of Patent: Nov. 23, 1999

[54] IMAGE FORMING APPARATUS HAVING A PROTECTION UNIT TO PROTECT A SENSITIVE IMAGE FORMING ELEMENT WHICH IS EXPOSED WHEN AN OPEN/CLOSE MEMBER IS OPEN

[75] Inventors: Hiroyoshi Haga, Saitama; Yoshiaki Nagao, Kanagawa, both of Japan

[73] Assignee: Ricoh Company, Ltd., Tokyo, Japan

[21] Appl. No.: 09/118,014

[22] Filed: Jul. 17, 1998

[30] Foreign Application Priority Data

Jul. 18, 1997 [JP] Japan ..... 9-209900

[51] Int. Cl.[6] ..... G03G 21/18

[52] U.S. Cl. ..... 399/114; 399/113; 399/125

[58] Field of Search ..... 399/114, 113, 399/111, 110, 125, 121, 302, 308

[56] References Cited

U.S. PATENT DOCUMENTS

| | | | |
|---|---|---|---|
| 5,170,209 | 12/1992 | Tompkins et al. | 399/107 |
| 5,587,769 | 12/1996 | Sawada et al. | 399/113 |
| 5,797,069 | 8/1998 | Kimura et al. | 399/113 |

FOREIGN PATENT DOCUMENTS

| | | |
|---|---|---|
| 5-72910 | 3/1993 | Japan . |
| 8-272229 | 10/1996 | Japan . |

*Primary Examiner*—Matthew S. Smith

*Attorney, Agent, or Firm*—Oblon, Spivak, McClelland, Maier & Neustadt, P.C.

[57] ABSTRACT

An image forming apparatus includes an open/close member is provided to be movable to a main frame between an open position and a closed position. A sensitive image forming element is provided to be placed in an exposed condition when the open/close member is moved to the open position. A protection unit is provided to be movable to the sensitive image forming element between an active position and a retracted position, the protecting unit being moved to the active position when the open/close member is set at the open position, so that the protection unit protects the sensitive image forming element so as to prevent the sensitive image forming element from being erroneously touched, and the protection unit being moved to the retracted position when the open/close member is set at the closed position, so that the protection unit does not restrain an operation of the sensitive image forming element.

19 Claims, 13 Drawing Sheets

IMAGE FORMING APPARATUS HAVING A PROTECTION UNIT TO PROTECT A SENSITIVE IMAGE FORMING ELEMENT WHICH IS EXPOSED WHEN AN OPEN/CLOSE MEMBER IS OPEN

BACKGROUND OF THE INVENTION (1) Field of the Invention

The present invention relates to an image forming apparatus in which a sensitive image forming element is placed in an exposed condition when an open/close member is set at an open position.

(2) Description of the Related Art

There is known an image forming apparatus, such as an electrophotographic copier, a printing press, a printer, a facsimile or a composite system having two or more such image forming capabilities. Such an image forming apparatus is provided with an open/close member which is retractable. During a normal operation of the image forming apparatus, the open/close member is set at a closed position. When any image forming element of the image forming apparatus needs replacement or repair, or when a jam or the like occurs, the open/close member is set at an open position, so that an operator can look into the inside of the image forming apparatus and can perform the replacement or the repair.

Generally, the image forming apparatus includes sensitive image forming elements which are sensitive to dirt and oil and should not be touched. For example, a photoconductive medium and an intermediate transfer medium, which serve as an image support for supporting a toner image thereon, are sensitive to dirt or oil and should not be touched. If the operator touches the photoconductive medium or the intermediate transfer medium, the fingerprint or oil sticks to the surface of such image supports. The quality of an image which is subsequently formed with the affected image forming elements is considerably degraded.

When the image forming apparatus is configured such that the sensitive image forming element is placed in an exposed condition when the open/close member is set at the open position, it is difficult to avoid that the operator erroneously touches the sensitive image forming element which is placed in the exposed condition.

In addition, the image forming apparatus includes sensitive image forming elements which are subject to dirt or oil and affect an operability of replacement or repair of the operator. For example, a toner case is subject to the toner and affects the operability of replacement or repair of the operator. When the image forming apparatus is configured such that the sensitive image forming element is placed in an exposed condition when the open/close member is set at the open position, it is difficult to avoid that the operator erroneously touches the sensitive image forming element which is placed in the exposed condition. Hereinafter, the image forming elements which are sensitive to dirt or oil and the image forming elements which are subject to dirt or oil are collectively called the sensitive image forming elements.

Japanese Laid-Open Patent Application No. 5-72910 discloses an image forming apparatus which utilizes the intermediate transfer medium. When a jam of a recording sheet occurs in the image forming apparatus, a region of a sheet transport path near resist rollers can be placed in an exposed condition so that removal of the recording sheet can be done by the operator. A side surface of the intermediate transfer medium is covered by a cover member so as to prevent the operator from erroneously touching the side surface of the intermediate transfer medium during the removal of the recording sheet. However, in the image forming apparatus of the above publication, it is difficult for the cover member to protect an image transfer area of the intermediate transfer medium in which the recording sheet and the intermediate transfer medium contact each other.

Japanese Laid-Open Patent Application No. 8-272229 discloses an image forming apparatus which utilizes the intermediate transfer medium. In the image forming apparatus, the intermediate transfer medium is placed in an exposed condition when an open/close member is set at an open position. When a jam of a recording sheet occurs, the open/close member is rotated to the open position, so that removal of the recording sheet can be done by the operator. A cover member is provided to cover an image transfer area of the intermediate transfer medium. In accordance with the rotation of the open/close member to the open position, the cover member is moved to cover an image transfer area of the intermediate transfer medium in which the recording sheet and the intermediate transfer medium contact each other. Hence, the cover member protects the intermediate transfer medium so as to prevent the operator from erroneously touching the intermediate transfer medium during the removal of the recording sheet.

In the image forming apparatus of the above publication, an intermediate transfer unit including the intermediate transfer medium and the cover member is provided, and the intermediate transfer unit is removable from a main frame of the apparatus when the intermediate transfer unit needs replacement or repair. When a jam occurs in the image forming apparatus, the entire surface of the intermediate transfer medium, confronting the sheet transport path inclusive of the image transfer area, is covered by the cover member. The operator can safely remove the jamming recording sheet from the image forming apparatus without affecting the toner image on the intermediate transfer medium.

In the image forming apparatus of the above publication, after a toner image is transferred to a recording sheet, the recording sheet with the toner image on the back side of the recording sheet is transported to a fixing unit through a sheet transport path above the intermediate transfer medium. In order to produce a good-quality image on the recording sheet, it is necessary to avoid subjecting the toner image on the back side of the recording sheet to friction or vibration when the recording sheet is passed through the sheet transport path from the image transfer area to the fixing unit.

However, in the image forming apparatus of the above publication, the cover member is located to cover the image transfer area of the intermediate transfer medium which interferes with the sheet transport path. When the recording sheet is passed through the sheet transport path, the toner image on the back side of the recording sheet may be subjected to friction or vibration by the interference with the cover member. Also, the recording sheet when it is being passed through the sheet transport path tends to be lowered by the gravity. However, the image forming apparatus of the above publication is not provided with a holding unit which effectively holds the recording sheet at a lifted position against the gravity when the recording sheet is being passed through the sheet transport path.

In the image forming apparatus of the above publication, if the toner image on the back side of the recording sheet is subjected to friction or vibration when the recording sheet is passed through the sheet transport path from the image transfer area to the fixing unit, the quality of an image which is formed from the affected toner image on the back side of the recording sheet is considerably degraded.

SUMMARY OF THE INVENTION

An object of the present invention is to provide an improved image forming apparatus in which the above-described problems are eliminated.

Another object of the present invention is to provide an image forming apparatus which effectively protects a sensitive image forming element which is placed in an exposed position when the open/close member is set at the open position, so that the sensitive image forming element is prevented from being erroneously touched.

The above-mentioned objects of the present invention are achieved by an image forming apparatus which comprises: a first image support which supports a toner image on the first image support; a second image support which supports the toner image, transferred from the first image support, on the second image support; a transfer unit which transfers the toner image on the second image support to a recording sheet at a transfer position where the recording sheet is brought into contact with the second image support by the transfer unit; a rotating member which rotates the second image support around a central axis of the rotating member, the rotating member supporting the rotation of the second image support at the transfer position where the toner image is transferred from the second image support to the recording sheet; a fixing unit having a pair of rollers which fix the toner image to the recording sheet when the pair of rollers contact the recording sheet after the toner image is transferred to the recording sheet; an open/close member which is provided to be movable between an open position and a closed position, wherein a portion of the image forming apparatus is exposed when the open/close member is set at the open position, the portion including at least the transfer position on the second image support; and a protection unit which is provided to be movable between an active position and a retracted position in accordance with a movement of the open/close member, the protection unit being moved to the active position when the open/close member is set at the open position, so as to substantially cover the transfer position on the second image support with the protection unit, and the protection unit being moved to the retracted position when the open/close member is set at the closed position, so as not to restrain an operation of the second image support. In the image forming apparatus, the retracted position of the protection unit is determined by a position where a portion of the protection unit, nearest to a transport path of the recording sheet when the protection unit is at the retracted position, is located below a line between a central contact point of the second image support and the transfer unit and a central contact point of the pair of rollers of the fixing unit, and above a line between a central point of the rotating axis of the rotating member and the central contact point of the pair of rollers of the fixing unit.

In the image forming apparatus of the present invention, the sensitive image forming element is placed in the exposed condition when the open/close member is set at the open position. The protection unit is provided to be movable between the active position and the retracted position. The protection unit is moved to the active position when the open/close member is set at the open position. The protection unit is moved to the retracted position when the open/close member is set at the closed position. The protection unit which is set at the active position effectively protects the sensitive image forming element so as to prevent the sensitive image forming element from being erroneously touched by the operator when the open/close member is at the open position. The protection unit which is set at the retracted position does not restrain the operation of the sensitive image forming element in the image forming apparatus. It is possible for the image forming apparatus of the present invention to provide not only a good operability for the replacement or the repair by the operator but also an effective protection of the sensitive image forming element during the replacement or the repair.

Further, in the image forming apparatus of the present invention, the retracted position of the protection unit is determined by a position where a portion of the protection unit, nearest to a transport path of the recording sheet when the protection unit is at the retracted position, is located below a line between a central contact point of the second image support and the transfer unit and a central contact point of the pair of rollers of the fixing unit, and above a line between a central point of the rotating axis of the rotating member and the central contact point of the pair of rollers of the fixing unit. It is possible to facilitate the provision of a small-size image forming apparatus as well as the protection of the toner image on the back side of the recording sheet from friction or vibration during the transport in the sheet transport path between the transfer unit and the fixing unit.

BRIEF DESCRIPTION OF THE DRAWINGS

Other objects, features and advantages of the present invention will become more apparent from the following detailed description when read in conjunction with the accompanying drawings in which.

DETAILED DESCRIPTION OF THE PREFERRED EMBODIMENTS

A description will now be given of the preferred embodiments of the present invention with reference to the accompanying drawings.

Figure 1:
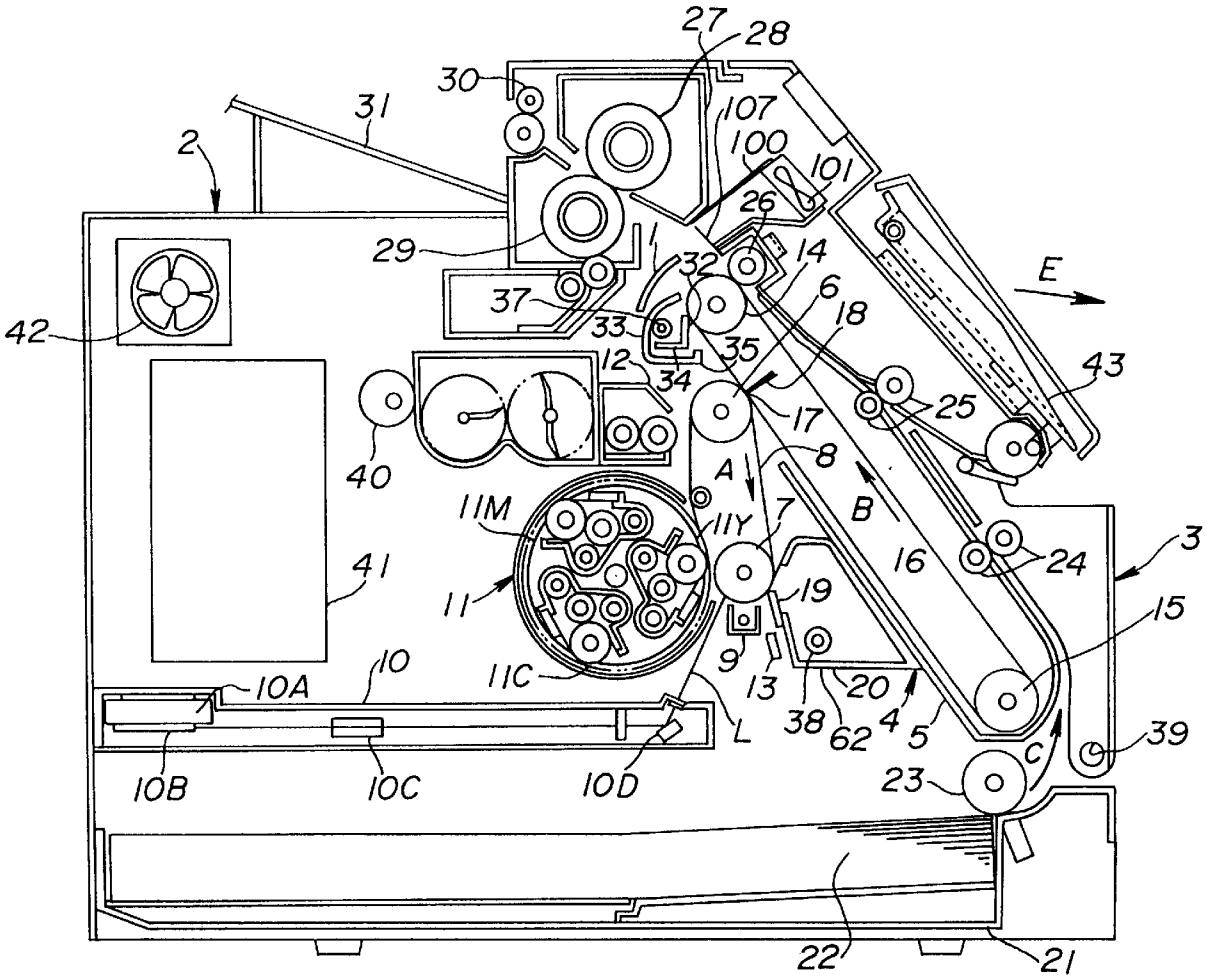
FIG. 1 is a cross-sectional view of one embodiment of an image forming apparatus of the present invention.

FIG. 1 shows one embodiment of an image forming apparatus of the present invention. Specifically, a color laser beam printer is shown in FIG. 1 for the purpose of illustration of an embodiment of the image forming apparatus of the present invention.

In the image forming apparatus of FIG. 1, a main frame 2 is installed in a stationary condition on a floor of a building or the like. In the present embodiment, an open/close frame 3 is provided on the front side of the main frame 2, and the open/close frame 3 is rotatably supported on the main frame 2 by a shaft 39. The open/close frame 3 is rotatable around the shaft 39 relative to the main frame 2 in a direction indicated by the arrow "E" in FIG. 1. Hence, the open/close frame 3 is movable between an open position and a closed position. In the image forming apparatus of FIG. 1, the open/close frame 3 is set at the closed position. The open/close frame 3 can be set at the open position as in the image forming apparatus shown in FIG. 2 (or FIG. 3).

In the image forming apparatus of FIG. 1, a process unit 4 in which a plurality of image forming elements are incorporated is removably attached to the main frame 2. The process unit 4 is called an electrophotographic process cartridge.

In the image forming apparatus of FIG. 1, a process unit case 5 is provided to accommodate the process unit 4 therein. A belt pulley 6 and a belt pulley 7 are rotatably supported on the process unit case 5. An endless-belt photoconductive medium 8 is wound on the belt pulley 6 and the belt pulley 7. The photoconductive medium 8 serves as an image support which supports an electrostatic latent image or a toner image thereon.

Alternatively, a drum-like photoconductive medium, a drum-like dielectric medium, or a belt-like dielectric medium may used instead of the photoconductive medium 8. When a print start button (not shown) of the image forming apparatus is pushed, the photoconductive medium 8 is rotated in a direction of the arrow "A" indicated in FIG. 1 by rotation of the belt pulley 6 and the belt pulley 7.

In the image forming apparatus of FIG. 1, a charger 9 is provided such that the charger 9 confronts the photoconductive medium 8. The charger 9 is supported on the process unit case 5. The charger 9 charges the surface of the photoconductive medium 8 when the photoconductive medium 8 is rotated.

In the main frame 2 of the image forming apparatus of FIG. 1, a laser exposure unit 10, a rotary multicolor developing unit 11, and a black developing unit 12 are supported.

At a downstream position of the charger 9 on the photoconductive medium 8, a laser scan area is provided, and the laser exposure unit 10 scans the laser scan area of the photoconductive medium 8. The laser exposure unit 10 includes a laser light source (not shown) which emits a laser beam. In the laser exposure unit 10, a motor 10A, a polygonal mirror 10B, an f.θ lens 10C and a mirror 10D are provided. The polygonal mirror 10B is rotated by the motor 10A. The laser beam from the laser light source is reflected by the polygonal mirror 10B. The laser beam from the polygonal mirror 10B passes through the f.θ lens 10C. The laser beam from the f.θ lens 10C is reflected by the mirror 10D, and the reflected laser beam (which is indicated by "L" in FIG. 1) is directed to the laser scan area of the charged surface of the photoconductive medium 8. Hence, the charged surface of the photoconductive medium 8 is exposed to the laser beam "L" from the laser exposure unit 10, and an electrostatic image is formed on the charged surface of the photoconductive medium 8.

The multicolor developing unit 11 is provided at a downstream position of the laser scan area of the photoconductive medium 8. In the multicolor developing unit 11, a yellow developing unit 11Y, a magenta developing unit 11M and a cyan developing unit 11C are incorporated. The yellow developing unit 11Y, the magenta developing unit 11M and the cyan developing unit 11C respectively contain a yellow toner, a magenta toner and a cyan toner (or secondary color toners). As the developing agent of the multicolor developing unit 11, either a two-component developing agent including a toner and a carrier or a one-component developing agent including a toner only may be used. Alternatively, a liquid-like developing agent may be used in the multicolor developing unit 11. In the present embodiment, a power-like developing agent is used in the multicolor developing unit 11.

The black developing unit 12 is provided above the multicolor developing unit 11 and around the photoconductive medium 8. The black developing unit 7 contains a black toner. As the developing agent of the black developing unit 7, either a two-component developing agent including a toner and a carrier or a one-component developing agent including a toner only may be used. Alternatively, a liquid-like developing agent may be used in the black developing unit 7. In the present embodiment, a power-like developing agent is used in the black developing unit 12.

In the multicolor developing unit 11, one of the three developing units 11Y, 11M and 11C is selectively connected to the photoconductive medium 8 at a timing of development with respect to a corresponding one of the secondary color toners. The multicolor developing unit 11 adheres a corresponding one of the secondary toners (the yellow toner, the magenta toner and the cyan toner) to regions of the electrostatic image where the charge is eliminated, so as to visualize the electrostatic image on the surface of the photoconductive medium 8 into a toner image. The multicolor developing unit 11 is rotatably supported, and the multicolor developing unit 11 can connect a selected one of the three developing units to the photoconductive medium 8 by revolution of 360°/3.

When one of the three developing units of the multicolor developing unit 11 is attached to the photoconductive medium 8, the black developing unit 12 is separated from the photoconductive medium 8. The black developing unit 12 is attached to the photoconductive medium 8 at a timing of development with the black toner. The separating and attaching movements of the black developing unit 12 relative to the photoconductive medium 8 are performed by rotation of a cam 40. The black developing unit 12 adheres the black toner to the electrostatic image of the photoconductive medium 8 in a manner similar to the multicolor developing unit 11.

At lower peripheral portions of the photoconductive medium 8, a discharging lamp 13 and a cleaning blade 19 are provided. The discharging lamp 13 discharges the surface of the photoconductive medium 8. The cleaning blade 19 is attached to the photoconductive medium 8. The cleaning blade 19 removes the remaining toner on the surface of the photoconductive medium 8 after a toner image of a first color (for example, yellow) on the photoconductive medium 8 is transferred, and cleans the surface of the photoconductive medium 8 before a next toner image of a second color (for example, magenta) is formed thereon. A toner case 20 is provided integrally with the process unit case 5 adjacent to the cleaning blade 19, and the remaining toner removed from the photoconductive medium 8 by the cleaning blade 19 is collected into the toner case 20.

In the image forming apparatus of FIG. 1, a belt pulley 14 and a belt pulley 15 are rotatably supported on the process unit case 5. An endless intermediate transfer belt 16 is wound on the belt pulley 14 and the belt pulley 15. The intermediate transfer belt 16 is rotatably supported on the belt pulley 14 and the belt pulley 15. The intermediate transfer belt 16 serves as an image support which supports a toner image, transferred from the surface of the photoconductive medium 8, on the surface of the intermediate transfer belt 16.

As shown in FIG. 1, the intermediate transfer belt 16 is provided adjacent to the photoconductive medium 8. During the rotation of the photoconductive medium 8, the intermediate transfer belt 10 is rotated in a direction of the arrow "B" indicated in FIG. 1 by rotation of the belt pulleys 14 and 15.

As described above, the electrostatic image on the photoconductive medium 8 is visualized into a toner image by the multicolor developing unit 11 and the black developing unit 7 with a corresponding toner. In the image forming apparatus of FIG. 1, this procedure is repeated with respect to each of the yellow toner, the magenta toner, the cyan toner and the black toner. Such toner images are sequentially transferred from the photoconductive medium 8 to the intermediate transfer belt 16 in an overlaying manner at an image transfer area 17. A transfer brush 18 is provided inside the intermediate transfer belt 16, and the transfer brush 18 transfers the toner image on the surface of the photoconductive medium 8 to the surface of the intermediate transfer belt 16. A voltage whose polarity is opposite to the polarity of the toner is applied to the transfer brush 18, and by using the transfer brush 18 the toner image is transferred to the surface of the intermediate transfer belt 16. Alternatively, a transfer roller, a transfer blade or a corona discharger may be used instead of the transfer brush 18.

The toner image on the surface of the photoconductive medium 8 with respect to each of the secondary colors and black is transferred to the surface of the intermediate transfer belt 16 every time the intermediate transfer belt 16 is rotated by one revolution. It is necessary that the toner images related to the secondary colors and black are transferred from the photoconductive medium 8 to the intermediate transfer belt 16 at the same location in an overlaying manner. Hence, a multicolor toner image is formed on the intermediate transfer belt 16, and the multicolor toner image is transferred from the intermediate transfer belt 16 to a recording sheet, such as a copy sheet or a plastic sheet.

After the toner image is transferred to the intermediate transfer belt 16, the remaining toner is left on the surface of the photoconductive medium 8. The remaining toner on the surface of the photoconductive medium 8 is removed by the cleaning blade 19 to clean the surface of the photoconductive medium 8. The toner case 20 is provided adjacent to the cleaning blade 19, and the remaining toner removed from the photoconductive medium 8 by the cleaning blade 19 is collected into the toner case 20. The cleaning blade 19 and the toner case 20 constitute a cleaning unit 62 for the photoconductive medium 8. A toner transport screw 38 is provided within the toner case 20. The remaining toner in the toner case 20 is ejected out of the toner case 20 by rotating the toner transport screw 38.

In the image forming apparatus of FIG. 1, a paper cassette 21 is provided at a lower portion of the main frame 2. In the paper cassette 21, a plurality of recording sheets 22, such as copy sheets or plastic sheets, are stacked. A paper supply roller 23 is provided on the paper cassette 21 By rotating the paper supply roller 23, the recording sheets 22 from the paper cassette 21 are supplied one by one to paper transport rollers 24 in a direction indicated by the arrow "C" in FIG. 1. The paper transport rollers 24 are rotatably supported on the open/close frame 3 and the process unit case 5. The paper transport rollers 24 transport the recording sheet to resist rollers 25 such that the recording sheet is once stopped at the resist rollers 25. The resist rollers 25 are rotatably supported on the open/close frame 3 and the process unit case 5. By rotating the resist rollers 25 at a controlled time, the resist rollers 25 supply the recording sheet to a transfer position between the intermediate transfer belt 16 and a transfer roller 26 such that the transfer roller 26 transfers the multicolor toner image on the surface of the intermediate transfer belt 16 to the recording sheet in synchronism with the rotation of the intermediate transfer belt 16.

The transfer roller 26 is provided at a transfer position of the intermediate transfer belt 16, and the transfer roller 26 transfers the multicolor toner image on the surface of the intermediate transfer belt 10 to the recording sheet. A voltage whose polarity is opposite to the polarity of the toner is applied to the transfer roller 26, and the multicolor toner image is transferred from the intermediate transfer belt 16 to the recording sheet by the transfer roller 26. The transfer roller 26 is rotatably supported on the open/close frame 3. Alternatively, a transfer brush, a transfer blade or a corona discharger may be used instead of the transfer roller 26.

In the image forming apparatus of FIG. 1, a fixing unit 27 is provided above the intermediate transfer belt 16, and the fixing unit 27 subjects the recording sheet to heat and pressure. The fixing unit 27 is supported on the main frame 2, and the fixing unit 27 includes a fixing roller 28 and a pressure roller 29. After the multicolor toner image is transferred to the recording sheet by the transfer roller 26, the recording sheet is passed through the fixing unit 27 and subjected to heat and pressure by the fixing roller 28 and the pressure roller 29 such that the multicolor image is fixed to the recording sheet. The recording sheet with the multicolor image formed on the back side of the recording sheet is ejected to a paper stack portion 31 by rotation of ejection rollers 30. The ejection rollers 30 are rotatably supported on the main frame 2. The paper stack portion 31 is provided on the top of the main frame 2 of the image forming apparatus.

After the multicolor toner image is transferred from the intermediate transfer belt 16 to the recording sheet, the remaining toner is left on the surface of the intermediate transfer belt 16. The remaining toner on the surface of the intermediate transfer belt 16 is removed by a cleaning unit 35 to clean the surface of the intermediate transfer belt 16. The cleaning unit 35 is provided for the intermediate transfer belt 16.

The cleaning unit 35 is provided adjacent to the belt pulley 14 of the intermediate transfer belt 16. The cleaning unit 35 includes a cleaning blade 32, a toner case 33, a cleaning blade arm (not shown), and a toner receiving element 34. The cleaning blade 32 is movably fitted to the surface of the intermediate transfer belt 16 around the belt pulley 14 through the cleaning blade arm. The cleaning blade 32 is attached to or separated from the surface of the intermediate transfer belt 16 by using the cleaning blade arm.

The toner case 33 is formed by a portion of the process unit case 5, and the cleaning blade 32 is provided within the toner case 33. The cleaning blade arm is movably supported on the process unit case 5, and a base portion of the cleaning blade 32 is fixed to the cleaning blade arm. The toner receiving element 34 is also fixed to the cleaning blade arm. The remaining toner removed from the surface of the intermediate transfer belt 16 by the cleaning blade 32 falls down to the toner receiving element 34 and is collected into the toner case 33. When the toner image is transferred from the photoconductive medium 8 to the intermediate transfer belt 16, the cleaning blade 32 is separated from the surface of the intermediate transfer belt 10 by using the cleaning blade arm. The cleaning blade 32 is attached to the surface of the intermediate transfer belt 16 by using the cleaning blade arm after the multicolor toner image is transferred from the intermediate transfer belt 16 to the recording sheet. The cleaning blade 32 removes the remaining toner on the surface of the intermediate transfer belt 16 after the multicolor toner image is transferred to the recording sheet. A toner transport screw 37 is provided within the toner case 33. The remaining toner in the toner case 33 is ejected out of the toner case 33 by rotating the toner transport screw 37.

In the image forming apparatus of FIG. 1, a controller unit 41 is provided on the left-hand side of the main frame 2. A fan 42 is provided above the controller unit 41. The fan 42 functions to move air for cooling of the internal elements within the image forming apparatus so as to prevent the temperature inside the image forming apparatus from rising to an excessively high temperature. A small-size paper cassette 43 is provided on the open/close frame 3. The small-size paper cassette 43 contains a small number of recording sheets and is optionally attached to the image forming apparatus.

In the above-described image forming apparatus, the color image formation related to yellow, magenta, cyan and black is carried out by using the multicolor developing unit 11 and the black developing unit 12. However, the present invention is not limited to the above-described embodiment. In a case of another image forming apparatus in which the color image formation related to a single color or two or three colors is carried out, the same procedure as those in the above-described image forming apparatus may be performed by selectively using the multicolor developing unit 11 or the black developing unit 12.

As described above, in the image forming apparatus of FIG. 1, the open/close frame 3 is rotatable around the shaft 39 relative to the main frame 2. Hence, the open/close frame 3 is movable between the open position and the closed position.

Figure 2:
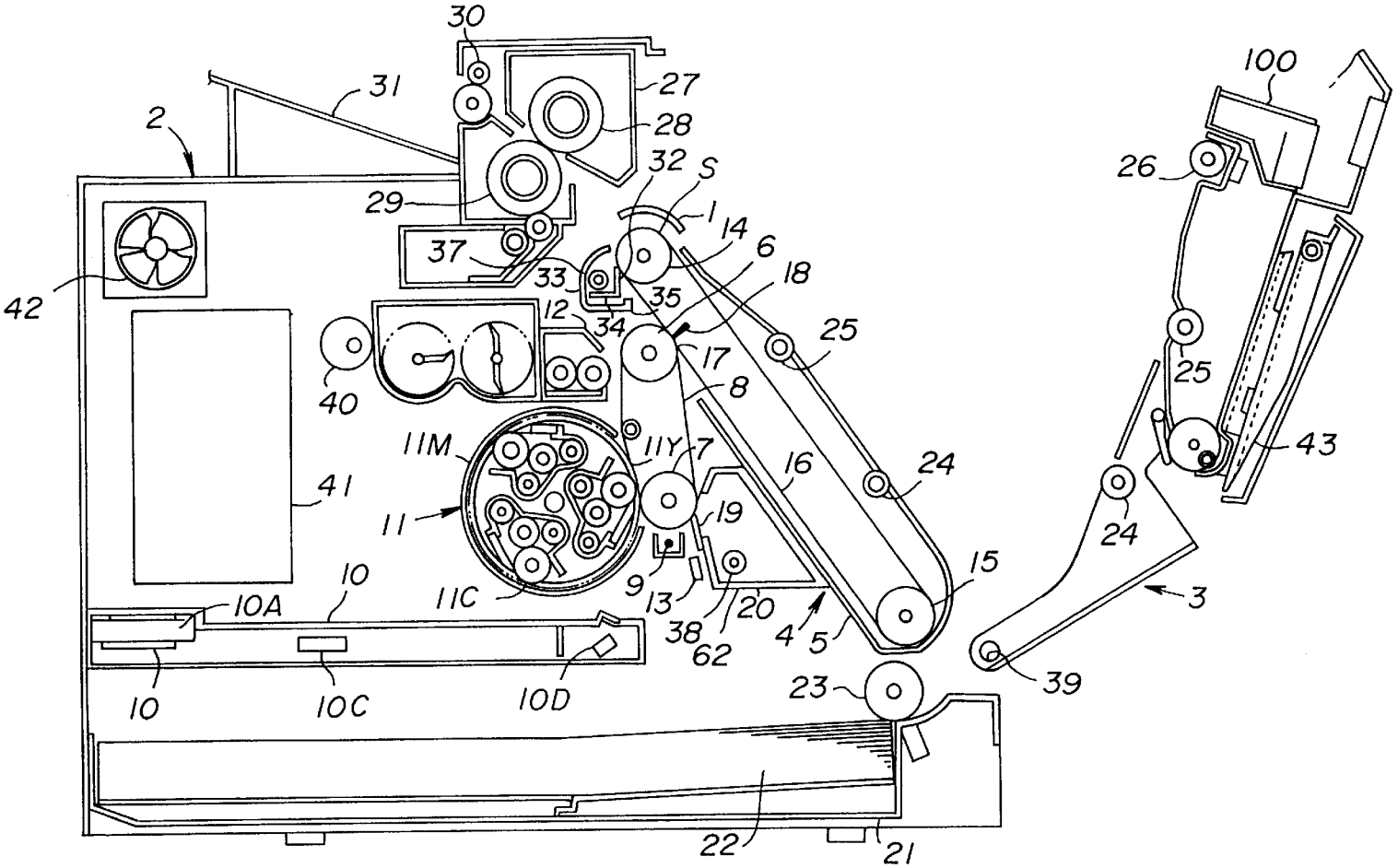
FIG. 2 is a cross-sectional view of the image forming apparatus in which an open/close frame is set at an open position.
Figure 3:
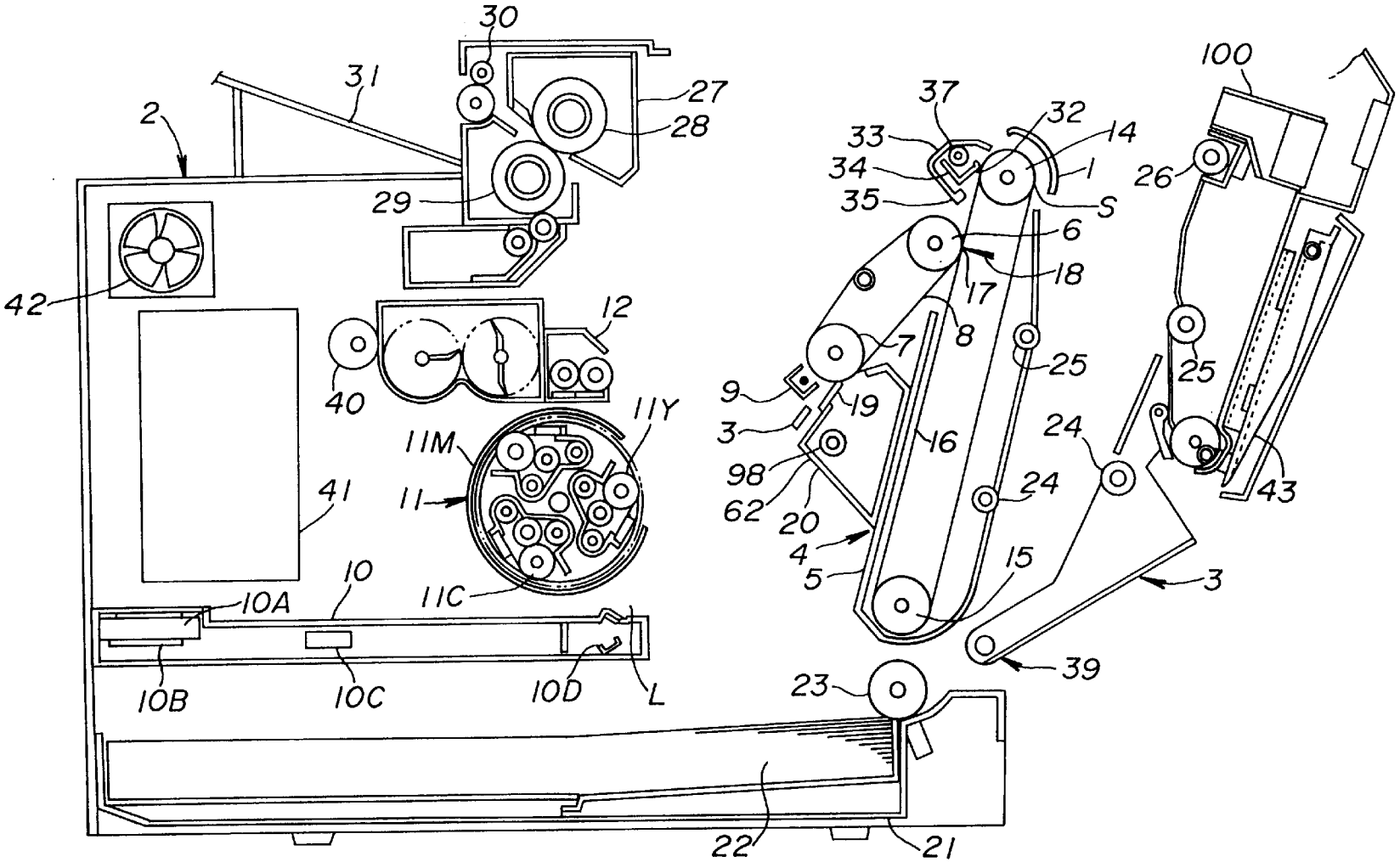
FIG. 3 is a cross-sectional view of the image forming apparatus in which a process unit case is set at an open position and the open/close frame is set at the open position.

FIG. 2 shows a condition of the image forming apparatus in which the open/close frame 3 is set at the open position. FIG. 3 shows a condition of the image forming apparatus in which the process unit case 5 is set at the open position and the open/close frame 3 is set at the open position.

As shown in FIG. 3, the process unit case 5 is rotatable around a central axis of the belt pulley 15 of the intermediate transfer belt 16 relative to the main frame 2. The process unit case 5 is movable between the open position and the closed position. When the process unit case 5 is set at the open position, the operator can easily remove the process unit case 5 from the main frame 2 by lifting the process unit case 5.

Accordingly, in the above-described image forming apparatus, when the process unit 4 needs replacement or repair, the operator can easily change the process unit case 5 by a new one by setting the open/close frame 3 and the process unit case 5 at the open positions. Similarly, when the multicolor developing unit 11 needs replacement or repair, the multicolor developing unit 11 can be easily changed by a new one. When the black developing unit 12 needs replacement or repair, the black developing unit 12 can be easily changed by a new one. Further, when a jam or another trouble occurs in the image forming apparatus, a repair can be easily done by setting the open/close frame 3 and/or the process unit case 5 to the open positions as shown in FIG. 2 and FIG. 3.

In the image forming apparatus which is configured as shown in FIG. 1, it is not necessary for an operator to look into several positions of the image forming apparatus when performing the repair or the replacement. The operator has only to stand in the right-hand area of the image forming apparatus without moving to another location, and the operator can easily perform the repair or the replacement by setting the open/close frame 3 and/or the process unit case 5 at the open positions. Hence, the image forming apparatus which is configured as shown in FIG. 1 provides a good operability for the replacement or the repair of the operator.

In the above-described image forming apparatus, when the open/close frame 3 is set at the open position, an image transfer area, indicated by "S" in FIG. 2 and FIG. 3, of the intermediate transfer belt 16 is placed in an exposed condition. As described above, the multicolor image from the intermediate transfer belt 16 is transferred at the image transfer area S to the recording sheet by the transfer roller 26. Other areas of the intermediate transfer belt 16, except for the image transfer area S, are covered with the process unit case 5 even when the open/close frame 3 is set at the open position.

However, the image transfer area S is located in the sheet transport path between the transfer roller 26 and the intermediate transfer belt 16, and it is necessary that the image transfer area S be placed in the exposed condition (or the image transfer area S is not covered with the process unit case 5) when the open/close frame 3 is set at the open position. If the operator touches the image transfer area S of the intermediate transfer belt 16 when the open/close frame 3 is set at the open position, the fingerprint or oil sticks to the surface of the intermediate transfer belt 16. Hence, the quality of an image which is subsequently formed by the image forming apparatus with the affected intermediate transfer belt 16 is considerably degraded.

In order to solve the above-mentioned problem, the image forming apparatus of the present embodiment is provided with a protection unit 1. In the present embodiment, the image forming apparatus has the open/close frame 3, and the image transfer area S of the intermediate transfer belt 16 (which is a sensitive image forming element) is placed in an exposed condition when the open/close frame 3 is set at the open position.

In the image forming apparatus according to the present invention, the protection unit 1 is moved to an active position (as shown in FIG. 2 or FIG. 3) when the open/close frame 3 is set at the open position, and the protection unit 1 is moved to a retracted position (as shown in FIG. 1) when the open/close frame 3 is set at the closed position. The protection unit 1, which is set at the active position as shown in FIG. 2 or FIG. 3, protects the image transfer area S of the intermediate transfer belt 16 so as to prevent the image transfer area S of the intermediate transfer belt 16 from being touched by the operator. The protection unit 1, which is set at the retracted position as shown in FIG. 1, does not restrain the operation of the intermediate transfer belt 16 at the image transfer area S.

In the image forming apparatus of FIG. 1, after the toner image is transferred to the recording sheet by the transfer roller 26, the recording sheet with the toner image on the back side of the recording sheet is transported in a sheet transport path above the intermediate transfer belt 16. This layout is useful to provide a small-size image forming apparatus and save internal space of the image forming apparatus. However, in order to produce a good-quality image on the recording sheet, it is necessary to avoid subjecting the toner image on the back side of the recording sheet to friction or vibration when the recording sheet is passed through the sheet transport path from the image transfer area S of the intermediate transfer belt 16 to the fixing unit 27.

In the image forming apparatus of FIG. 1, a vacuum unit 100 is provided above the sheet transport path between the transfer roller 26 (or a second transfer position of the intermediate transfer belt 16) and the fixing unit 27. The vacuum unit 100 includes a fan 101 and a suction port 107. The vacuum unit 100 produces an actuating pressure to pull the recording sheet passing the sheet transport path by rotating the fan 101 so as to suck up air from the suction port 107 at a constant flow rate. The vacuum unit 100 functions to hold the recording sheet at a lifted position against the gravity when the recording sheet is being passed through the sheet transport path. Hence, by using the vacuum unit 100, it is possible for the image forming apparatus of FIG. 1 to avoid subjecting the toner image on the back side of the recording sheet to friction or vibration when the recording sheet is passed through the sheet transport path.

Next, a description will be given of various examples of the protection unit in the image forming apparatus of the present invention.

Figure 4:
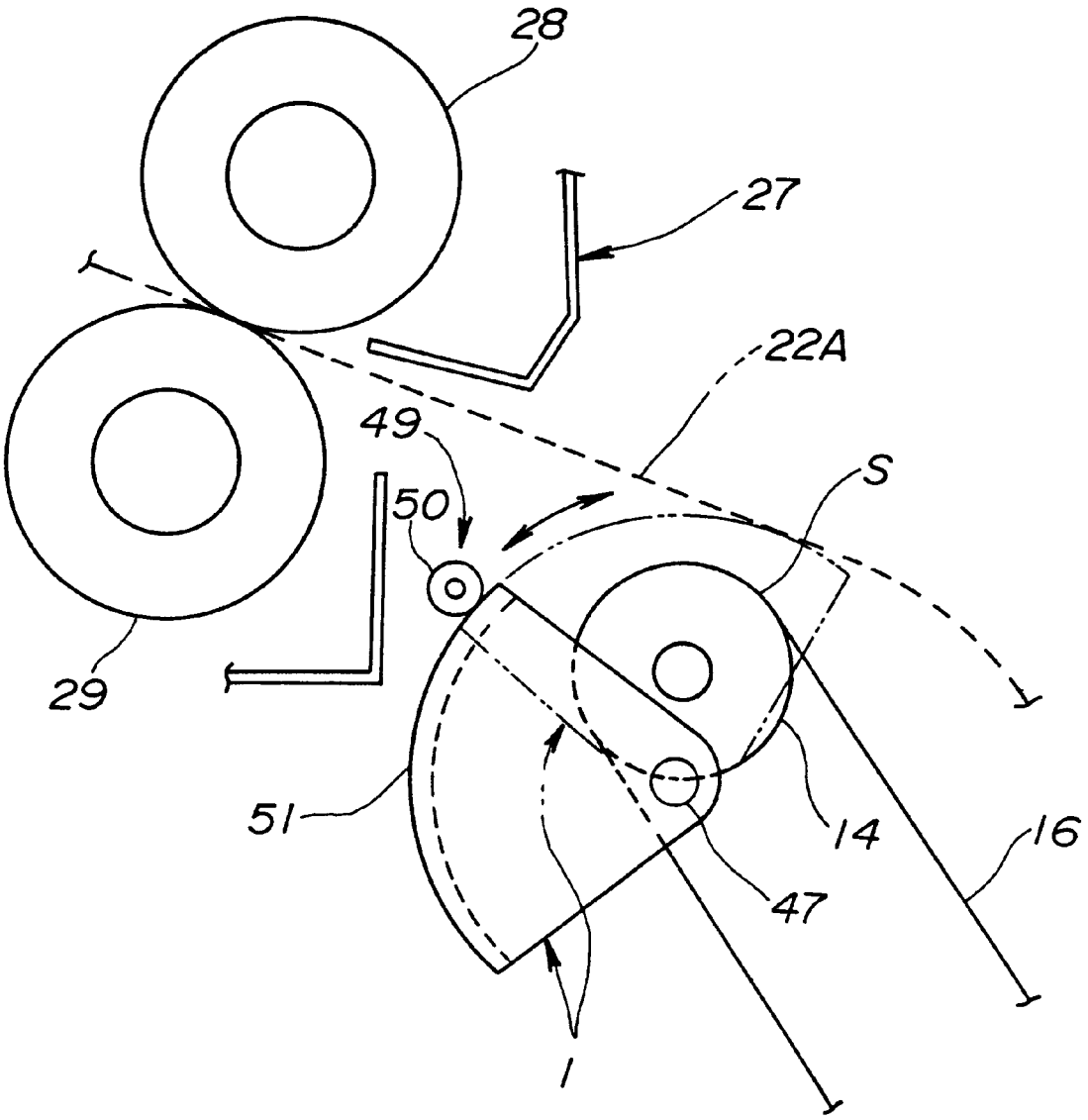
FIG. 4 is a diagram illustrating an example of a protection unit and a drive motor in the image forming apparatus of the present invention.
Figure 5:
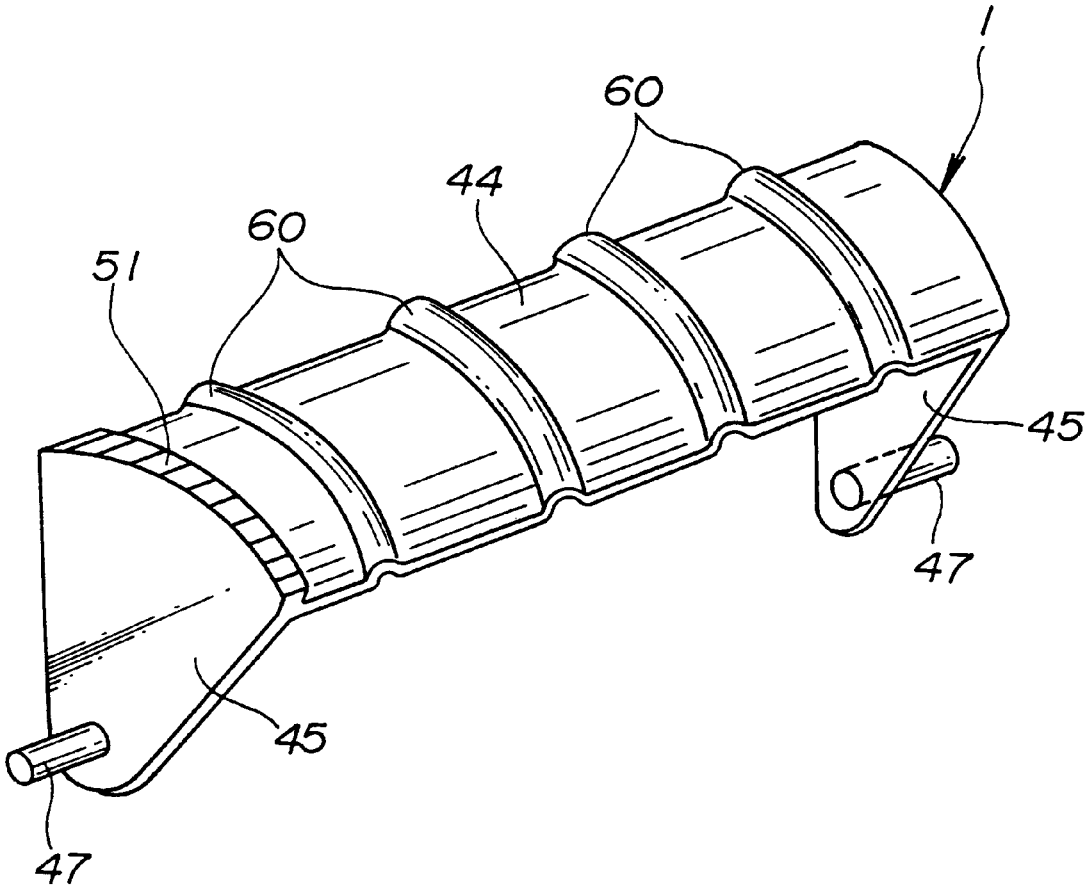
FIG. 5 is a perspective view of the protection unit of FIG. 4.

FIG. 4 shows an example of the protection unit and a drive motor in the image forming apparatus of the present invention. FIG. 5 is a perspective view of the protection unit of FIG. 4.

As shown in FIG. 4 and FIG. 5, the protection unit 1 of this example generally has a longitudinally extending cover plate portion 44, side walls 45 at both ends of the cover plate portion 44, and pins 47 outwardly extending from the side walls 45. The protection unit 1 has the overall length that is larger than the overall width of the intermediate transfer belt 16. The cover plate portion 44 has a longitudinal length larger than the overall width of the intermediate transfer belt 16, and the cover plate portion 44 can fully cover the overall width of the image transfer area S of the intermediate transfer belt 16.

The pins 47 are fitted to the process unit case 5 such that the protection unit 1 is rotatably supported on the process unit case 5 by the pins 47. Hence, the protection unit 1 is rotatable around the pins 47 between the active position and the retracted position. The side walls 45 are provided in the shape of a segment of a circle, and the pins 47 are located at the center of the segment of the circle of the side walls 45. The cover plate portion 44 has a curved surface whose cross section matches with the circular arc of the side walls 45. The protection unit 1 of the present example further includes a driven gear 51 provided along the circular edge of one of the side walls 45.

As shown in FIG. 4, in the image forming apparatus of the present embodiment, a drive motor 49 is provided to move the protection unit 1 between the active position (indicated by a two-dot chain line in FIG. 4) and the retracted position (indicated by a solid line in FIG. 4). The drive motor 49 is supported on the process unit case 5. A driving gear 50 is rotatably supported on the process unit case 5, and the driving gear 50 is engaged with the driven gear 51 of the protection unit 1. The drive motor 49 rotates the driving gear 50, and the protection unit 1 is rotated around the pins 47 by the rotation of the drive motor 49 through the engagement of the driving gear 50 and the driven gear 51.

In the image forming apparatus of the present embodiment, when the open/close frame 3 is set at the open position, the drive motor 49 starts rotating the driving gear 50 counterclockwise in response to the opening movement of the open/close frame 3. The protection unit 1 is rotated around the pins 47 to the active position, indicated by the two-dot chain line in FIG. 4, by the rotation of the drive motor 49. After the protection unit 1 is moved to the active position, the drive motor 49 stops rotating the driving gear 50. The protection unit 1, which is set at the active position, protects the image transfer area S of the intermediate transfer belt 16 so as to prevent the image transfer area S of the intermediate transfer belt 16 from being touched by the operator.

On the other hand, when the open/close frame 3 is set at the closed position, the drive motor 49 starts rotating the driving gear 50 clockwise in response to the closing movement of the open/close frame 3. The protection unit 1 is rotated around the pins 47 to the retracted position, indicated by the solid line in FIG. 4, by the rotation of the drive motor 49. After the protection unit 1 is moved to the retracted position, the drive motor 49 stops rotating the driving gear 50. The protection unit 1, which is set at the retracted position, does not restrain the operation of the intermediate transfer belt 16 at the image transfer area S.

In the image forming apparatus of the present embodiment, a first switch (not shown) is provided in the open/close frame 3 to detect the start of the movement of the open/close frame 3, and a second switch (not shown) is provided in the protection unit 1 to detect the end of the movement of the protection unit 1 to the active position. When the open/close frame 3 starts the opening movement from the closed position to the open position, the first switch is turned ON. The drive motor 49 starts rotating the driving gear 50 counterclockwise in response to the ON state of the first switch. When the protection unit 1 is moved to the active position, the second switch is turned OFF. The drive motor 49 stops rotating the driving gear 50 counterclockwise in response to the OFF state of the second switch.

On the other hand, when the open/close frame 3 starts the closing movement from the open position to the closed position, the first switch is turned ON. The drive motor 59 starts rotating the driving gear 50 clockwise in response to the ON state of the first switch. When the protection unit 1 is moved to the retracted position, the second switch is turned OFF. The drive motor 49 stops rotating the driving gear 50 clockwise in response to the OFF state of the second switch.

In the above-described embodiment of FIG. 4 and FIG. 5, the protection unit 1 is automatically moved to the active position by the rotation of the drive motor 49 when the open/close frame 3 is set at the open position, and the protection unit 1 is automatically moved to the retracted position by the rotation of the drive motor 49 when the open/close frame 3 is set at the closed position. The protection unit 1 and the driving gear 50 are rotatably supported on the process unit case 5. The drive motor 49 is supported on the process unit case 5. The protection unit 1 which is set at the active position as shown in FIG. 2 (even when the process unit case 5 is set at the open position shown in FIG. 3) effectively protects the image transfer area S of the intermediate transfer belt 16 so as to prevent the image transfer area S of the intermediate transfer belt 16 from being touched by the operator. The protection unit 1 which is set at the retracted position as shown in FIG. 1 does not restrain the operation of the intermediate transfer belt 16 at the image transfer area S.

Accordingly, it is possible for the image forming apparatus of the present embodiment to provide not only a good operability for the replacement or the repair by the operator but also an effective protection of the sensitive image forming element during the replacement or the repair.

However, in the above-described embodiment of FIG. 4 and FIG. 5, the use of the drive motor 49 causes the cost of the image forming apparatus to be increased. Although the protection unit 1 can be reliably moved between the active position and the retracted position by using the drive motor 49, it is difficult to provide an inexpensive image forming apparatus in which the protection unit 1 and the drive motor 49 are incorporated.

Figure 6:
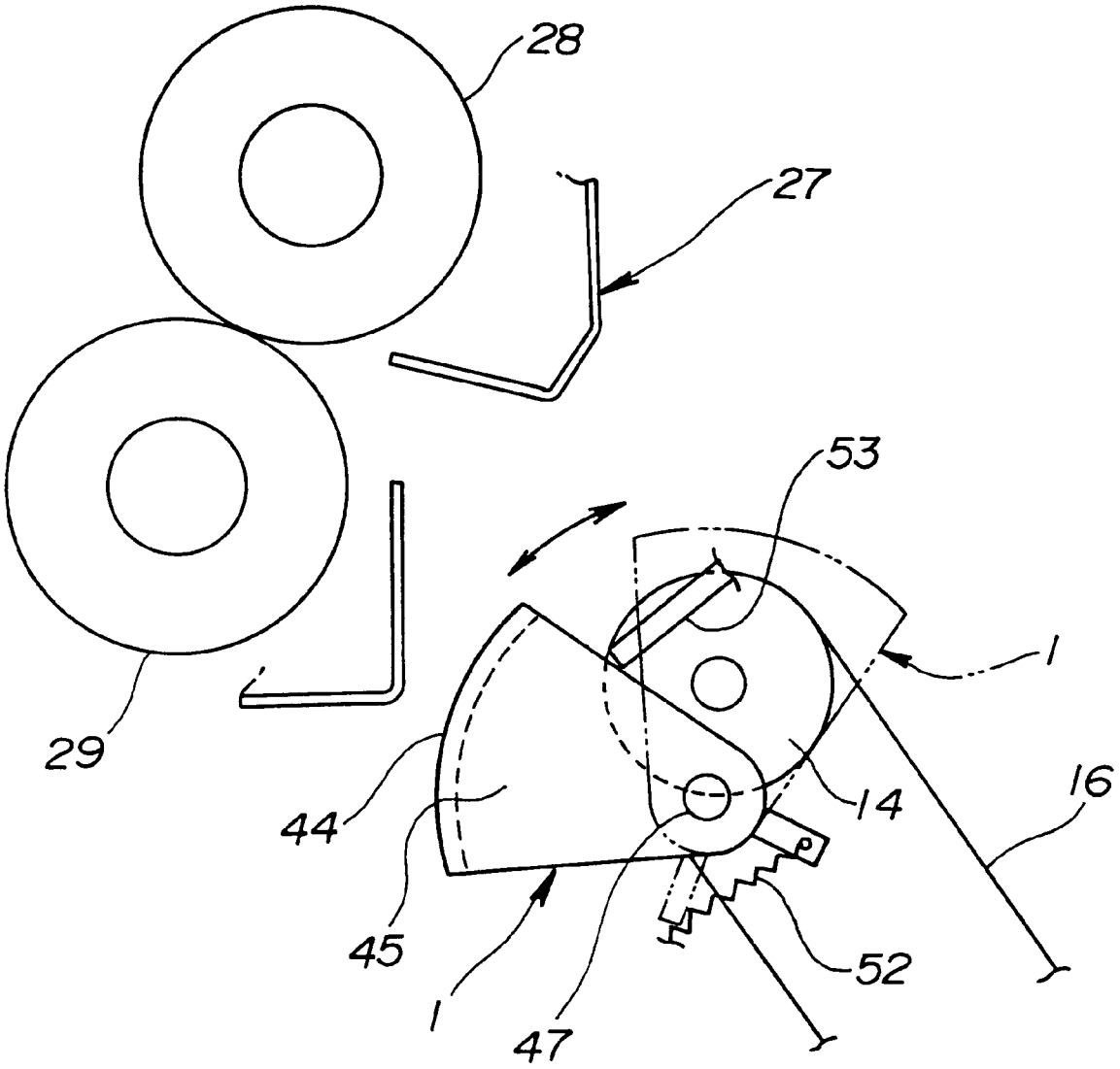
FIG. 6 is a diagram illustrating an example of a protection unit and an actuation unit in the image forming apparatus of the present invention.

Next, FIG. 6 shows an example of a protection unit and an actuation unit in the image forming apparatus of the present invention. In the present embodiment, the drive motor 49 of FIG. 4 is not used to move the protection unit 1 between the active position and the retracted position, and an actuation unit is used instead.

In the example of FIG. 6, the protection unit 1 is essentially the same as the protection unit 1 of FIG. 5. The protection unit 1 of this example generally has the cover plate portion 44, the side walls 45 at both ends of the cover plate portion 44, and the pins 47 outwardly extending from the side walls 45. The protection unit 1 has the overall length that is larger than the overall width of the intermediate transfer belt 16. The cover plate portion 44 can fully cover the overall width of the image transfer area S of the intermediate transfer belt 16.

The pins 47 are fitted to the process unit case 5 such that the protection unit 1 is rotatably supported on the process unit case 5 by the pins 47. Hence, the protection unit 1 is rotatable around the pins 47 between the active position (indicated by a two-dot chain line in FIG. 6) and the retracted position (indicated by a solid line in FIG. 6). The side walls 45 are provided in the shape of a segment of a circle, and the pins 47 are located at the center of the segment of the circle of the side walls 45. The cover plate portion 44 has a curved surface whose cross section matches with the circular arc of the side walls 45. However, the protection unit 1 of this example includes no driven gear like the driven gear 51 of FIG. 5 which is provided along the circular edge of one of the side walls 45.

As shown in FIG. 6, the protection unit 1 includes a lug outwardly extending from one of the side walls 45. The actuation unit of this embodiment includes a tension spring 52 connected at one end to the lug of the side wall 45. The lug is provided in the side wall 45 at a position opposite to the cover plate portion 44 and outwardly extends from the center of the segment of the circle of the side wall 45. The tension spring 52 is connected at the other end to the process unit case 5. The tension spring 52 exerts an actuating force on the protection unit 1 so as to actuate the protection unit 1 toward the active position indicated by a two-dot chain line in FIG. 6. The tension spring 52 is provided as part of the actuation unit in the present embodiment.

In the present embodiment, as shown in FIG. 6, the actuation unit further includes a pressing pin 53 which is provided in the open/close frame 3 such that the pressing pin 53 outwardly projects from the open/close frame 3. When the open/close frame 3 is set at the closed position as shown in FIG. 1, the pressing pin 53 is connected to the protection unit 1 as shown in FIG. 6. The protection unit 1 is set at the retracted position (indicated by the solid line in FIG. 6) against the actuating force of the tension spring 52 by the connection of the pressing pin 53 and the protection unit 1. Similar to the embodiment of FIG. 4, the protection unit 1, set at the retracted position does not restrain the operation of the intermediate transfer belt 16 at the image transfer area S.

On the other hand, when the open/close frame 3 is set at the open position as shown in FIG. 2, the pressing pin 53 of the open/close frame 3 is disconnected from the protection unit 1. The protection unit 1 is rotated around the pins 47 to the active position (indicated by the two-dot chain line in FIG. 6) by the actuating force of the tension spring 52. Similar to the embodiment of FIG. 4, the protection unit 1 of this example, which is set at the active position, protects the image transfer area S of the intermediate transfer belt 16 so as to prevent the image transfer area S of the intermediate transfer belt 16 from being touched by the operator. When the open/close frame 3 is again set at the closed position, the pressing pin 53 is connected to the protection unit 1, and the protection unit 1 is moved back to the retracted position.

In the above-described embodiment of FIG. 6, the protection unit 1 is moved to the active position by the actuating force of the tension spring 52 when the open/close frame 3 is set at the open position, and the protection unit 1 is moved to the retracted position against the actuating force of the tension spring 52 by the connection of the pressing pin 53 and the protection unit 1 when the open/close frame 3 is set at the closed position. The protection unit 1 is rotatably supported on the process unit case 5. The tension spring 52 is connected at one end to the protection unit 1 and connected at the other end to the process unit case 5. The protection unit 1 which is set at the active position as shown in FIG. 2 (even when the process unit case 5 is set at the open position shown in FIG. 3) effectively protects the image transfer area S of the intermediate transfer belt 16 so as to prevent the image transfer area S of the intermediate transfer belt 16 from being touched by the operator. The protection unit 1 which is set at the retracted position as shown in FIG. 1 does not restrain the operation of the intermediate transfer belt 16 at the image transfer area S.

Accordingly, it is possible for the image forming apparatus of the present embodiment to provide not only a good operability for the replacement or the repair by the operator but also an effective protection of the sensitive image forming element during the replacement or the repair.

However, in the above-described embodiment, when other elements, such as the fixing unit 27 and the transfer roller 26, are provided in the vicinity of the protection unit 1 within the image forming apparatus, it is difficult that the pressing pin 53 be provided near the protection unit 1 so as to rotate the protection unit 1 between the active position and the retracted position without interfering with the other elements.

Figure 7:
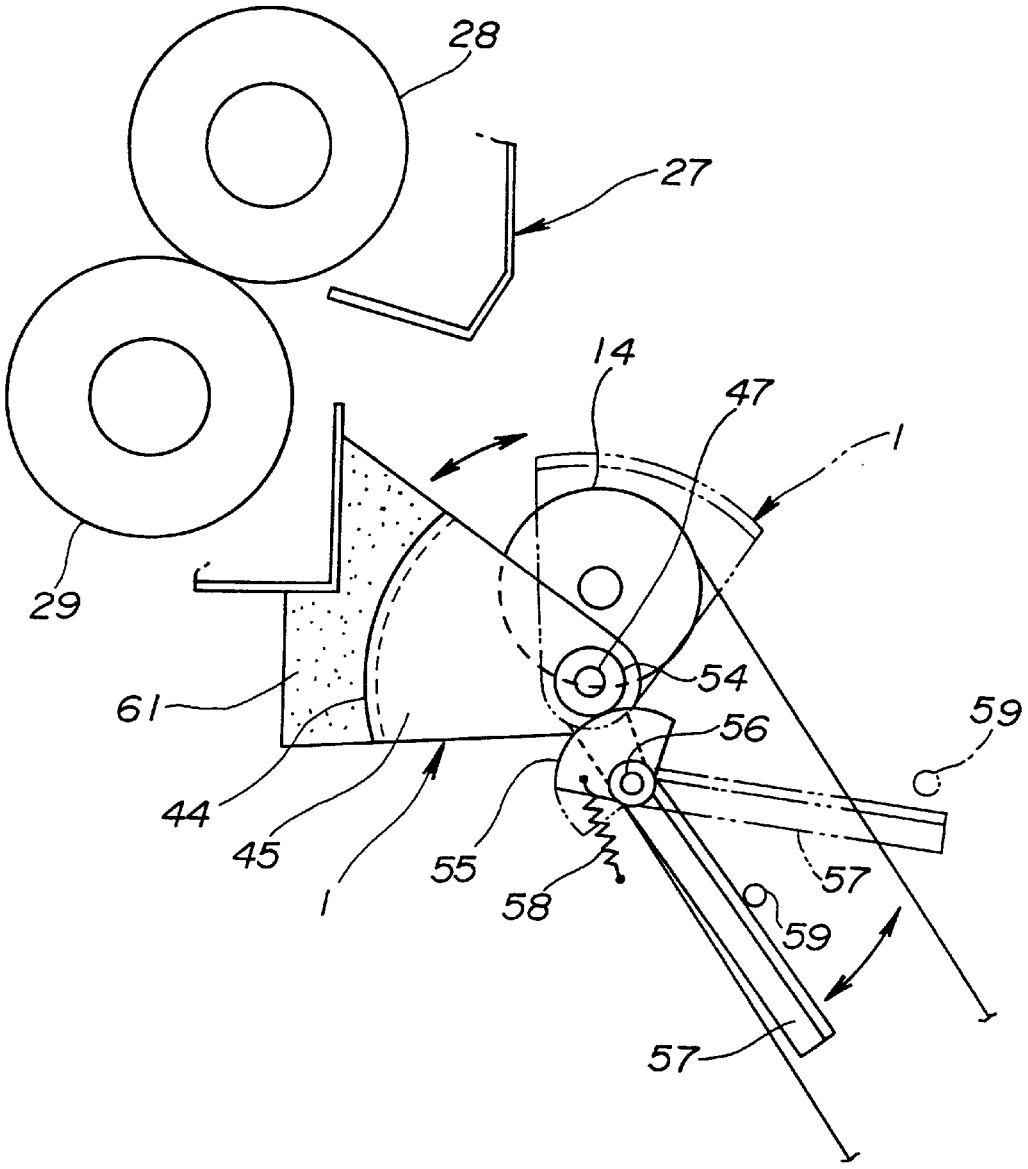
FIG. 7 is a diagram illustrating another example of the protection unit and the actuation unit in the image forming apparatus of the present invention.

Next, FIG. 7 shows another example of the protection unit and the actuation unit in the image forming apparatus of the present invention. In the present embodiment, the drive motor 49 of FIG. 4 is not used to move the protection unit 1 between the active position and the retracted position, and a different actuation unit is used instead.

In the example of FIG. 7, the protection unit 1 is essentially the same as the protection unit 1 of FIG. 5. The protection unit 1 of this example generally has the cover plate portion 44, the side walls 45 at both ends of the cover plate portion 44, and the pins 47 outwardly extending from the side walls 45. The protection unit 1 has the overall length that is larger than the overall width of the intermediate transfer belt 16. The cover plate portion 44 can fully cover the overall width of the image transfer area S of the intermediate transfer belt 16.

The pins 47 are fitted to the process unit case 5 such that the protection unit 1 is rotatably supported on the process unit case 5 by the pins 47. Hence, the protection unit 1 is rotatable around the pins 47 between the active position (indicated by a two-dot chain line in FIG. 7) and the retracted position (indicated by a solid line in FIG. 7). The side walls 45 are provided in the shape of a segment of a circle, and the pins 47 are located at the center of the segment of the circle of the side walls 45. The cover plate portion 44 has a curved surface whose cross section matches with the circular arc of the side walls 45.

However, the protection unit 1 of this example includes no driven gear like the driven gear 51 of FIG. 5 which is provided along the circular edge of one of the side walls 45. Instead, the protection unit 1 of FIG. 7 includes a driven gear 54 which is provided on the pin 47 of one of the side walls 45 such that the driven gear 54 and the protection unit 1 are together rotatable around the pin 47.

Further, as shown in FIG. 7, the actuation unit of this example includes a driving gear 55 which is rotatably supported on the process unit case 5 by a pin 56. The driving gear 55 is engaged with the driven gear 56 of the protection unit 1. The driving gear 55 is rotatable around the pin 56, and the position of the driving gear 55 relative to the process unit case 5 is fixed. In the present embodiment, the driving gear 55 is provided in the shape of a segment of a circle, and the driving gear 55 has a toothed portion along the circular arc of the segment of the circle.

The actuation unit of the example of FIG. 7 further includes a lever 57 which is fixed to the driving gear 55 at the pin 56 (or at the center of the rotation of the driving gear 55) such that the lever 57 and the driving gear 55 are together rotatable around the pin 56. The lever 57 outwardly extends from the position of the pin 56 in a direction opposite to the toothed portion of the driving gear 55.

The actuation unit of the example of FIG. 7 further includes a tension spring 58 which is connected at one end to the driving gear 55 and connected at the other end to the process unit case 5. The tension spring 58 exerts an actuating force on the driving gear 55 so as to rotate the driving gear 55 around the pin 56 counterclockwise. Since the driving gear 55 is engaged with the driven gear 54 of the protection unit 1, the protection unit 1 is pulled toward the active position, indicated by the two-dot chain line in FIG. 7, by the actuating force of the tension spring 58 through the engagement of the driving gear 55 and the driven gear 54.

The actuation unit of the example of FIG. 7 further includes a pressing pin 59 which is provided in the open/close frame 3 such that the pressing pin 59 outwardly projects from the open/close frame 3 in a direction parallel to the pin 56. The pressing pin 59 is provided as a pressing unit in the present embodiment.

When the open/close frame 3 is set at the closed position as shown in FIG. 1, the pressing pin 59 is connected to the lever 57 such that the lever 57 is held at a first position indicated by a solid line in FIG. 7. In this condition, the protection unit 1 is set at the retracted position (indicated by the solid line in FIG. 7) against the actuating force of the tension spring 58 by the connection of the pressing pin 59 and the lever 57. The retracted position of the protection unit 1 is located between the process unit case 5 and the fixing unit 27. Similar to the embodiment of FIG. 4, the protection unit 1, when it is set at the retracted position does not restrain the operation of the intermediate transfer belt 16 at the image transfer area S.

When a jam or the like occurs, or when any image forming element needs replacement or repair, the open/close frame 3 is set at the open position as shown in FIG. 2. The pressing pin 59 of the open/close frame 3 is disconnected from the lever 57. The lever 57 is rotated around the pin 56 counterclockwise to a second position indicated by a two-dot chain line in FIG. 7 by the actuating force of the tension spring 58. The lever 57 contacts a stopper (which is provided on the process unit case 5 but not shown in FIG. 7) when the lever 57 is rotated to the second position, and the lever 57 stops the rotation by the stopper. By the rotation of the lever 57, the protection unit 1 is rotated around the pins 47 clockwise to the active position through the engagement of the driving gear 55 and the driven gear 54. Similar to the embodiment of FIG. 4, the protection unit 1, when it is set at the active position, protects the image transfer area S of the intermediate transfer belt 16 so as to prevent the image transfer area S of the intermediate transfer belt 16 from being touched by the operator.

When the open/close frame 3 is again set at the closed position, the pressing pin 59 is connected to the lever 57, and the lever 57 is rotated around the pin 56 clockwise back to the first position. By the rotation of the lever 57, the protection unit 1 is moved back to the retracted position. The protection unit 1, when it is set at the retracted position, does not restrain the operation of the intermediate transfer belt 16 at the image transfer area S.

In the above-described embodiment of FIG. 7, the protection unit 1 is moved to the active position by the actuating force of the tension spring 58 through the engagement of the driving gear 55 and the driven gear 54 when the open/close frame 3 is set at the open position. The protection unit 1 is moved to the retracted position against the actuating force of the tension spring 58 by the connection of the pressing pin 59 and the lever 57 when the open/close frame 3 is set at the closed position. The protection unit 1 is rotatably supported on the process unit case 5. The tension spring 58 is connected at one end to the driving gear 55 and connected at the other end to the process unit case 5. The protection unit 1 which is set at the active position as shown in FIG. 2 (even when the process unit case 5 is set at the open position shown in FIG. 3) effectively protects the image transfer area S of the intermediate transfer belt 16 so as to prevent the image transfer area S of the intermediate transfer belt 16 from being touched by the operator. The protection unit 1 which is set at the retracted position as shown in FIG. 1 does not restrain the operation of the intermediate transfer belt 16 at the image transfer area S.

Accordingly, it is possible for the image forming apparatus of the present embodiment to provide not only a good operability for the replacement or the repair by the operator but also an effective protection of the sensitive image forming element during the replacement or the repair.

In the above-described embodiment of FIG. 7, the rotation of the protection unit 1 between the active position and the retracted position can be set in an arbitrary range of the rotation by predetermining a gear ratio between the driving gear 55 and the driven gear 54 at an appropriate value. Further, even when other elements, such as the fixing unit 27 and the transfer roller 26, are provided in the vicinity of the protection unit 1 within the image forming apparatus, the use of the lever 57 makes it possible to easily rotate the protection unit 1 between the active position and the retracted position without interfering with the other elements.

In the above-described embodiment of FIG. 7, the actuating force of the tension spring 58 is used, instead of the drive motor 49 of FIG. 4, to move the protection unit 1 between the active position and the retracted position. Hence, it is possible to provide an inexpensive image forming apparatus in which the protection unit 1 and the actuation unit are incorporated.

The protection unit 1 in the above-described embodiments of FIG. 4 through FIG. 7 is incorporated in the image forming apparatus of FIG. 1. As previously described, the image forming apparatus of FIG. 1 includes the photoconductive medium 8 which supports an electrostatic latent image or a toner image on the surface of the photoconductive medium 8. The multicolor developing unit 11 and the black developing unit 12 convert the latent image on the surface of the photoconductive medium 8 into a toner image. The intermediate transfer belt 16 supports the toner image, transferred from the surface of the photoconductive medium 8, on the surface of the intermediate transfer belt 16. The transfer brush 18 transfers the toner image on the surface of the photoconductive medium 8 to the surface of the intermediate transfer belt 16. The transfer roller 26 transfers the toner image on the surface of the intermediate transfer belt 16 to the recording sheet 22. The fixing unit 27 fixes the toner image, transferred from the surface of the intermediate transfer belt 16, to the recording sheet 22 by applying heat and pressure to the recording sheet 22. When the open/close frame 3 is set at the open position, the image transfer area S of the intermediate transfer belt 16 (which is sensitive to dirt and oil) is placed in the exposed condition.

Further, the protection unit 1 in the above-described embodiments of FIG. 4 through FIG. 7 may be incorporated in an image forming apparatus of another type having a configuration that is different from the configuration of FIG. 1. The above-mentioned image forming apparatus includes a photoconductive medium which supports an electrostatic latent image on a surface of the photoconductive medium. A developing unit converts the latent image on the surface of the photoconductive medium into a toner image. A transfer unit transfers the toner image on the surface of the photoconductive medium to a recording sheet. A fixing unit fixes the toner image, transferred from the surface of the photoconductive medium, to the recording sheet. In the above-mentioned image forming apparatus, when the open/close member is set at the open position, the photoconductive medium is placed in an exposed condition and sensitive to dirt and oil, and the protection unit 1 protects the photoconductive medium so as to prevent the photoconductive medium from being erroneously touched by the operator.

In the above-described image forming apparatus of FIG. 1, the open/close frame 3 is rotatably supported on the main frame 2. The process unit case 5 is configured such that at least the photoconductive medium 8 and the intermediate transfer belt 16 are incorporated therein. The process unit case 5 is rotatably supported on the main frame 2, and the process unit case 5 is detachable from the main frame 2 when the open/close frame 3 is set at the open position. When the open/close frame 3 is set at the open position, the image transfer area S of the intermediate transfer belt 16, which is sensitive to dirt and oil, is placed in the exposed condition, and at the same time the protection unit 1 is moved to the active position, so that the protection unit 1 protects the image transfer area S of the intermediate transfer belt 16 so as to prevent the image transfer area S of the intermediate transfer belt 16 from being erroneously touched by the operator. Therefore, the above-described image forming apparatus can provide an effective protection of the sensitive image forming element during the replacement or the repair by the operator.

Alternatively, the protection unit 1 may be configured such that, when an open/close member is set at an open position, the protection unit 1 is moved to a position at which the protection unit 1 protects the photoconductive medium 8 (which is sensitive to dirt and oil), so as to prevent the photoconductive medium 8 from being erroneously touched by the operator. In such a configuration, it is assumed that the process unit case 5 is the open/close member which is movable between an active position and a retracted position, and the photoconductive medium 8 is the sensitive image forming element which is placed in an exposed condition when the process unit case 5 is set at the open position as shown in FIG. 3. The protection unit 1 in the above configuration may be constructed in the image forming apparatus in a manner similar to the protection unit 1 as in the above-described embodiments of FIG. 4 through FIG. 7.

In the above-described embodiments of FIG. 4 through FIG. 7, it is likely that the protection unit 1 continuously stays in the vicinity of the fixing unit 27 when the protection unit 1 is moved to the retracted position. During a normal operation of the image forming apparatus, the open/close frame 3 is set at the closed position and the fixing unit 27 is heated to a high temperature. Hence, the protection unit 1 is subjected to the heat from the fixing unit 27, and the protection unit 1 may be deformed due to the heat from the fixing unit 27. In order to avoid the above problem, the protection unit 1 is provided to have an outside surface of a heat-resistant material (for example, a heat-resistant resin) that withstands the heat from the fixing unit 27.

In addition, in the above-described embodiments of FIG. 4 through FIG. 7, it is desirable to produce the protection unit 1 from a metallic material having a high stiffness, in order to ensure a reliable operation of the protection unit 1. However, a metallic material generally has a large thermal conduction coefficient. If the protection unit 1 of the metallic material is continuously subjected to the heat from the fixing unit 27, the protection unit 1 is heated to a high temperature. When the open/close frame 3 is set at the open position, it is desirable to prevent the operator from erroneously touching the heated protection unit 1.

Figure 8:
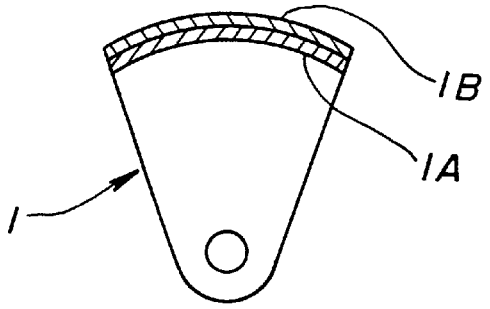
FIG. 8 is a cross-sectional view of a further example of the protection unit in the image forming apparatus of the present invention.

FIG. 8 is a cross-sectional view of a further example of the protection unit in the image forming apparatus of the present invention. The protection unit of this example is provided in the case in which the protection unit 1 stays in the vicinity of the fixing unit 27 when the protection unit 1 is moved to the retracted position.

As shown in FIG. 8, the protection unit 1 of this example is configured such that the protection unit 1 has an inner layer 1A of a metallic material and an outer layer 1B of a heat resistant material. The inner layer 1A of the metallic material is useful to provide a high stiffness of the protection unit 1. The outer layer 1B of the heat resistant material is useful to prevent the protection unit 1 from being deformed due to the heat from the fixing unit 27 even when the protection unit 1 continuously stays in the vicinity of the fixing unit 27. Therefore, the protection unit 1 of this example is advantageous in order to ensure not only safe and reliable operations of the protection unit 1 but also safe operations of the replacement and the repair by the operator. The configuration of the protection unit 1 shown in FIG. 8 can be suitably applied to all the above-described embodiments of FIG. 4 through FIG. 7.

In the image forming apparatus of FIG. 1, the image transfer area S of the intermediate transfer belt 16 is located in the sheet transport path between the transfer roller 26 and the intermediate transfer belt 16. In the above-described embodiments of FIG. 4 through FIG. 7, it is necessary that the active position (where the image transfer area S is protected) of the protection unit 1 overlap the sheet transport path between the transfer roller 26 and the intermediate transfer belt 16. However, there is a case in which a jam occurs in the sheet transport path (which the active position of the protection unit 1 overlaps), and a recording sheet 22A may be left in the sheet transport path as indicated by a dotted line in FIG. 4. The sheet transport path is located upstream of the fixing unit 27, and a toner image on the back side of the recording sheet 22A is not yet fixed to the recording sheet 22A by the fixing unit 27. If the recording sheet 22A exists in the sheet transport path when the open/close frame 3 is set at the open position, the non-fixed toner of the recording sheet 22A may stick to the protection unit 1 during the removal of the recording sheet 22A.

In order to provide a good operability for the replacement or the repair by the operator, the cover plate portion 44 of the protection unit 1 shown in FIG. 5 is formed with a plurality of projections 60. The projections 60 function to reduce the contact area between the recording sheet 22A and the cover plate portion 44 as small as possible. The protection unit 1 having the projections 60 formed on the cover plate portion 44 is useful to hinder the non-fixed toner of the recording sheet 22A from sticking to the protection unit 1.

As shown in FIG. 4 and FIG. 5, the projections 60 are provided on the cover plate portion 44 such that the projections 60 extend along the sheet transport path of the recording sheet 22A. The protection unit 1 having the projections 60 thus provided is useful to make the recording sheet 22A smoothly contact the protection unit 1. It is possible to provide a good operability for the removal of the jammed recording sheet by the operator. The configuration of the protection unit 1 shown in FIG. 5 can be suitably applied to the above-described embodiments of FIG. 6 and FIG. 7.

In order to provide an increased operability for the replacement or the repair by the operator, the protection unit 1 shown in FIG. 7 is provided with a cleaning unit 61. The cleaning unit 61 is provided such that the cleaning unit 61 contacts the cover plate portion 44 of the protection unit 1 when the protection unit 1 is moved to the retracted position. The cleaning unit 61 is made of a flexible material that does not restrict the movement of the protection unit 1 between the active position and the retracted position. It is desirable that the cleaning unit 61 is made of one of a felt, a foam and a brush. Even if the non-fixed toner of the recording sheet 22A sticks to the protection unit 1, the cleaning unit 61 functions to clean the protection unit 1 when the protection unit 1 is moved to the retracted position. The cleaning unit 61 may be supported on the main frame 2 or may be supported on the process unit case 5.

In the above-described image forming apparatus of FIG. 1, the open/close frame 3 is provided on the front side of the main frame 2, and is movable to the main frame 2 between the open position and the closed position. The configuration of the image forming apparatus of the present invention may be suitably applied to an image forming apparatus of another type in which an open/close door is provided on an upper side of a main frame and is movable to the main frame between an open position and a closed position. The configuration of the image forming apparatus of the present invention may be suitably applied to an image forming apparatus of still another type which is divided into an upper frame and a lower frame, the upper frame being an open/close member provided to be movable to the lower frame between an open position and a closed position. Further, the configuration of the image forming apparatus of the present invention may be suitably applied to an image forming apparatus in which a different sensitive image forming element, other than the photoconductive medium 8 or the intermediate transfer belt 16, is placed in an exposed condition when an open/close member is set at an open position.

Figure 9:
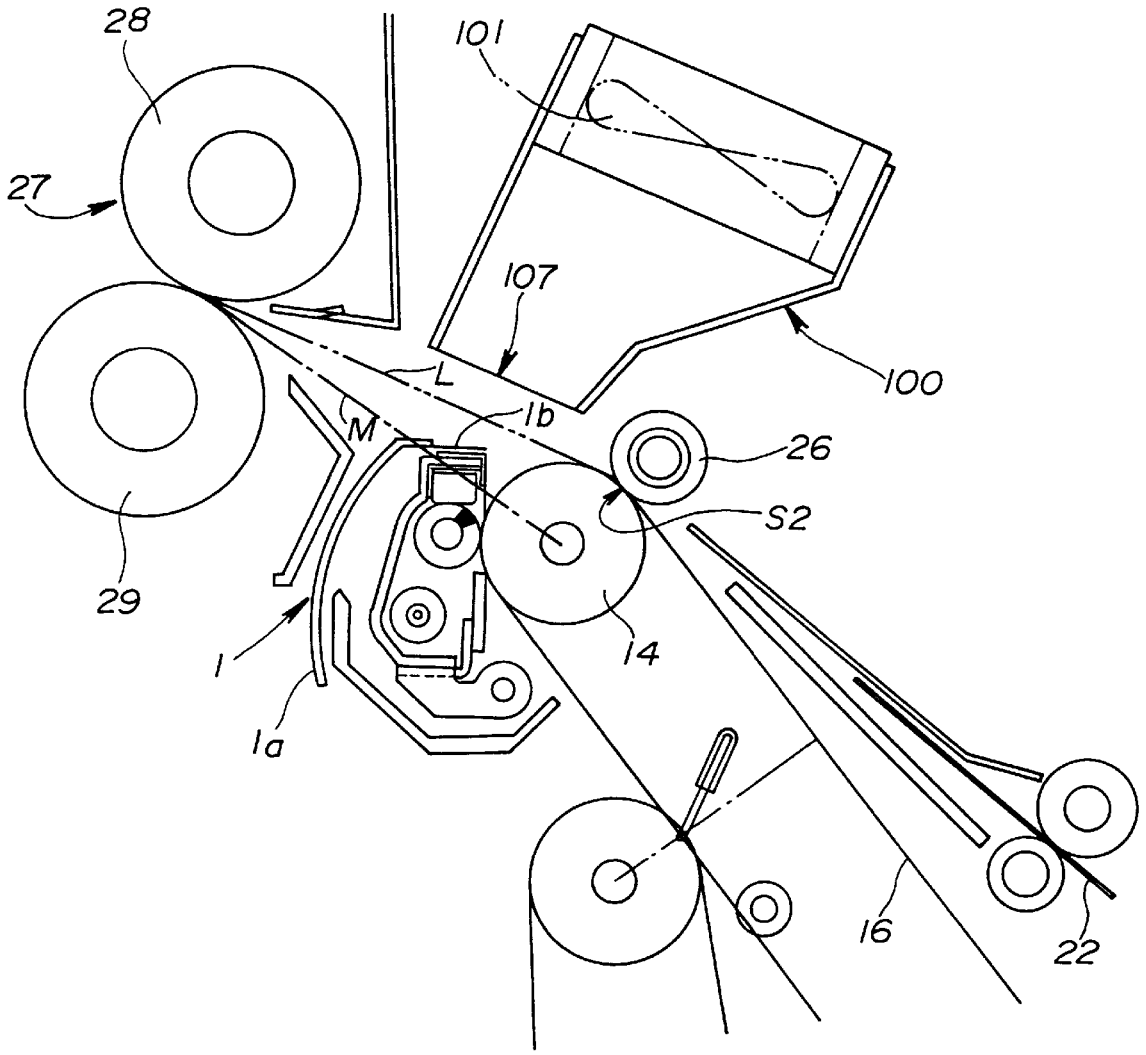
FIG. 9 is a diagram for explaining a retracted position of the protection unit in the image forming apparatus of FIG. 1.

Next, FIG. 9 shows a retracted position of the protection unit 1 in the image forming apparatus of the present invention.

As shown in FIG. 9, the protection unit 1 which is moved to the retracted position in the image forming apparatus of FIG. 1 is located near the sheet transport path between the transfer roller 26 and the fixing unit 27. As described above, after the toner image is transferred to the recording sheet by the transfer roller 26, the recording sheet with the toner image on the back side of the recording sheet is transported in the sheet transport path. In order to produce a good-quality image on the recording sheet, it is necessary to take account of the retracted position of the protection unit 1 in addition to the use of the vacuum unit 100. If the retracted position of the protection unit 1 is adequately distant from the sheet transport path, there is little possibility that the toner image on the back side of the recording sheet interfere with the protection unit 1. However, if the retracted position of the protection unit 1 is excessively distant from the sheet transport path, an internal space needed for the retraction of the protection unit 1 becomes large, which makes it difficult to provide a small-size image forming apparatus.

Therefore, it is desirable to determine an appropriate retracted position of the protection unit 1 which facilitates the provision of a small-size image forming apparatus as well as the protection of the toner image on the back side of the recording sheet from friction or vibration during the transport in the sheet transport path. As the result of several experiments concerning the retracted position of the protection unit 1, an optimal retracted position of the protection unit 1 for the image forming apparatus of the present embodiment is determined. That is, the retracted position of the protection unit 1 in the present embodiment is determined by a position where an end portion of the protection unit 1, nearest to the sheet transport path when the protection unit 1 is at the retracted position, is located below a line (indicated by a two-dot chain line "L" in FIG. 9) between a central contact point (a central point of a nip width of the belt 16 and the roller 26 in contact) of the intermediate transfer belt 16 and the transfer roller 26 and a central contact point (a central point of a nip width of the roller 28 and the roller 29 in contact) of the fixing roller 28 and the pressure roller 29 in the fixing unit 27, and located above a line (indicated by a one-dot chain line "M" in FIG. 9) between a central point of the rotating axis of the belt pulley 14 (on which the intermediate transfer belt 16 is rotatably supported) and the central contact point of the fixing roller 28 and the pressure roller 29.

In the image forming apparatus of FIG. 1, a first transport speed of the recording sheet at a second transfer position (indicated by "S2" in FIG. 9) and a second transport speed of the recording sheet at the fixing unit 27 are determined such that the first transport speed is greater than the second transport speed. The first transport speed is given by a linear speed of the rotation of the intermediate transfer belt 16 and the transfer roller 26. The second transport speed is given by a linear speed of the rotation of the fixing roller 28 and the pressure roller 29. Because of the difference between the first transport speed and the second transport speed, the recording sheet when it is transported through the sheet transport path between the second transfer position S2 and the fixing unit 27 is subjected to deflection. The recording sheet is held at the lifted position by the actuating pressure of the vacuum unit 100, and the recording sheet in the form of an upwardly curved loop is passed through the sheet transport path. Hence, the recording sheet passes by an upper transport path which is located slightly above the line "L".

It is conceivable to locate the end portion of the protection unit 1, nearest to the sheet transport path when the protection unit 1 is at the retracted position, on or slightly above the line L, in order to minimize the distance between the retracted position and the sheet transport path. As the result of several experiments, it is found that there is a possibility that, when the recording sheet is downwardly curled at the rear end thereof or has some thickness, the recording sheet during the transport in the sheet transport path be lowered from the line L by the gravity, even through the actuating pressure of the vacuum unit 100 is exerted on the recording sheet. To prevent the lowering of the recording sheet, the actuating pressure produced by the vacuum unit 100 may be increased. However, if the actuating pressure of the vacuum unit 100 is increased excessively, the transporting condition of the recording sheet becomes unstable, which subjects the toner image on the back side of the recording sheet to an increased level of vibration. It is found that the increase of the actuating pressure of the vacuum unit 100 causes the quality of an image on the recording sheet to be degraded.

In the image forming apparatus of the present embodiment, the retracted position of the protection unit 1 is determined by a position where the end portion of the protection unit 1, nearest to the sheet transport path when the protection unit 1 is at the retracted position, is located below the line "L" and above the line "M", and it is possible to facilitate the provision of a small-size image forming apparatus as well as the protection of the toner image on the back side of the recording sheet from friction or vibration during the transport in the sheet transport path.

In a preferred embodiment of the protection unit 1, as shown in FIG. 9, the protection unit 1 includes a main part 1*a* and an elastic sheet member 1*b* attached to an end of the main part 1*a* nearer to the sheet transport path when the protection unit 1 is at the retracted position. The sheet member 1*b* is made of a resin material or a rubber material and has a small thickness and some elasticity. The sheet member 1*b* may be fixed to the main part 1*a* by using an adhesive agent, press fitting or fastening screws. The sheet member 1*b* is useful to make as small as possible the distance between the retracted position of the protection unit 1 and the sheet transport path. Alternatively, a preferred embodiment of the protection unit 1 may be configured such that the main part 1*a* and the sheet member 1*b* are integrally formed by molding and a portion corresponding to the sheet member 1*b* is formed with a small thickness. The preferred embodiment of the protection unit 1 enables the distance between the retracted position of the protection unit 1 and the sheet transport path to be made as small as possible, and is useful to provide a small-size image forming apparatus and save an internal space for the protection unit 1 in the image forming apparatus.

Figure 10:
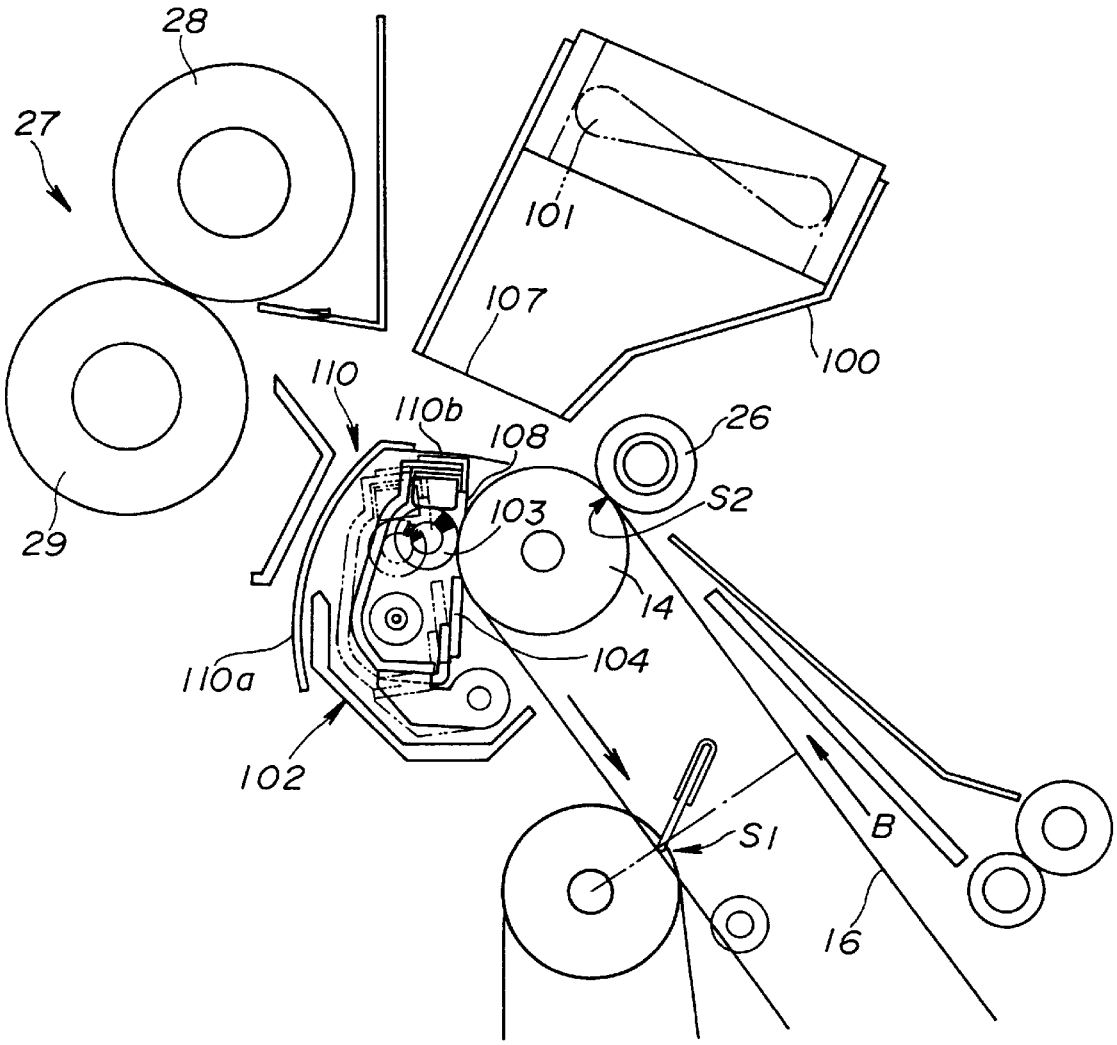
FIG. 10 is a diagram illustrating an example of a protection unit and a cleaning unit in another embodiment of the image forming apparatus of the present invention.

Next, FIG. 10 shows an example of a protection unit and a cleaning unit in another embodiment of the image forming apparatus of the present invention.

In the image forming apparatus of FIG. 10, after the multicolor toner image is transferred from the intermediate transfer belt 16 to the recording sheet, the remaining toner is left on the surface of the intermediate transfer belt 16. The remaining toner on the surface of the intermediate transfer belt 16 is removed by a cleaning unit 102 to clean the surface of the intermediate transfer belt 16. The cleaning unit 102 is provided between the second transfer position S2 (where the toner image is transferred from the intermediate transfer belt 16 to the recording sheet) and a first transfer position S1 (where the toner image is transferred from the photoconductive medium 8 to the intermediate transfer belt 16) along the direction (indicated by the arrow "B" in FIG. 10) of the rotation of the intermediate transfer belt 16.

The cleaning unit 102 is at a downstream position of the second transfer position S2 and at an upstream position of the first transfer position S1 with respect to the direction B of the rotation of the intermediate transfer belt 16. The cleaning of the intermediate transfer belt 16 is performed by the cleaning unit 102 after the end of the second transfer of a preceding toner image to a recording sheet by the transfer roller 26 and before the start of the first transfer of a following toner image to the intermediate transfer belt 16. Hence, the second transfer of the preceding toner image, the cleaning of the intermediate transfer belt 16 and the first transfer of the following toner image can be continuously performed.

The cleaning unit 102 of FIG. 10 includes a fur brush 103 and a cleaning blade 104, in addition to the elements 33, 34 and 37 of the cleaning unit 35 of FIG. 1. The cleaning unit 102 cleans the surface of the intermediate transfer belt 16 by the fur brush 103 and the cleaning blade 104. To remove the remaining toner from the surface of the intermediate transfer belt 16, the cleaning unit 102 needs a stiffness to resist the reaction from the intermediate transfer belt 16. The belt pulley 14 is firmly supported on the process unit case 5, and the intermediate transfer belt 16 is fastened at the second transfer position S2 between the transfer roller 26 and the belt pulley 14, and fastened at a downstream position (which confronts the second transfer position S2) between the cleaning unit 102 and the belt pully 14. The cleaning unit 102 is firmly attached to the intermediate transfer belt 16 against the belt pulley 14 during the cleaning action. The cleaning unit 102 uses the stiffness of the belt pulley 14 to resist the reaction from the intermediate transfer belt 16. The configuration of the cleaning unit 102 is useful to provide a small-size image forming apparatus and save an internal space for the cleaning unit in the image forming apparatus.

Figure 11:
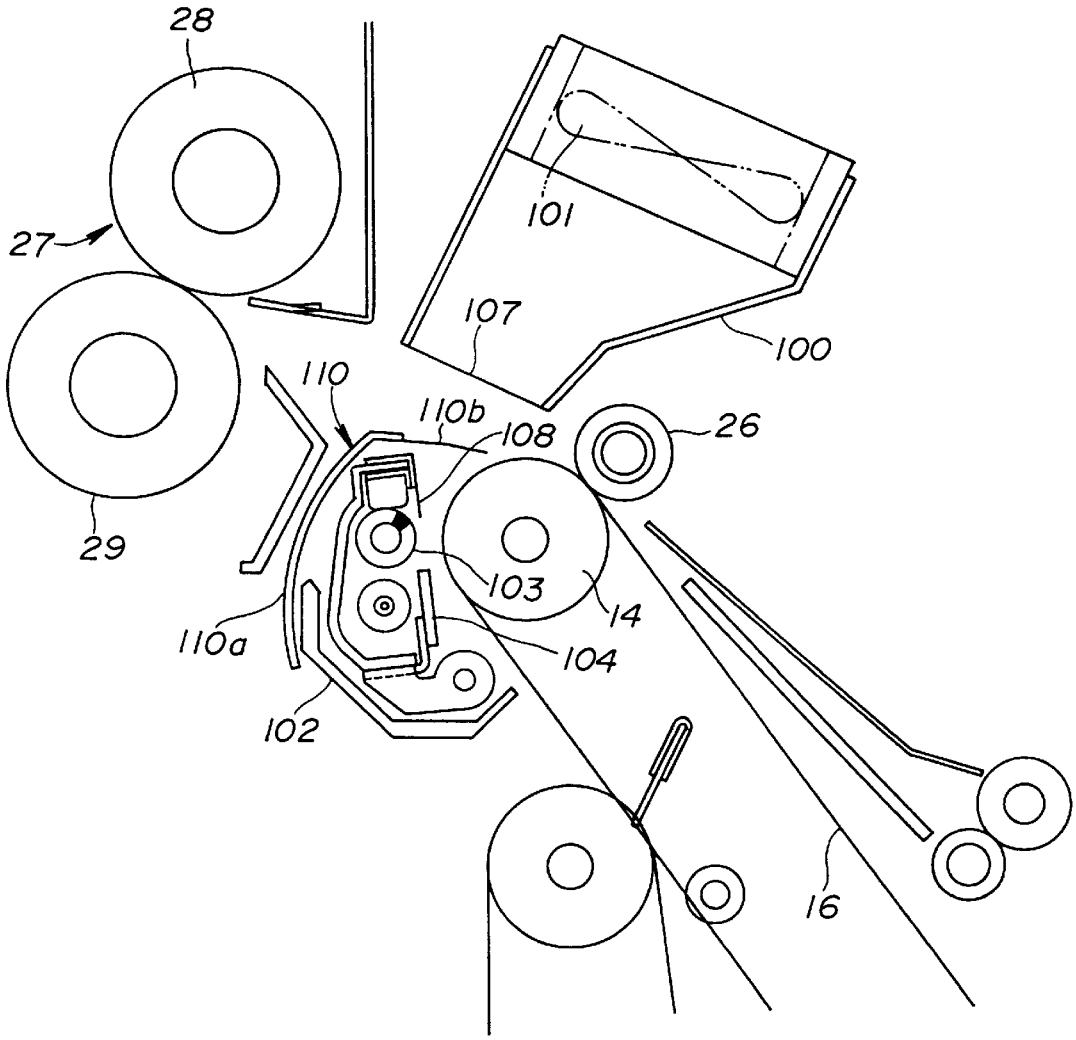
FIG. 11 is a diagram for explaining a separated position of the cleaning unit in the image forming apparatus of FIG. 10.

In the image forming apparatus of FIG. 10, it is necessary that the cleaning unit 102 is movably fitted to the surface of the intermediate transfer belt 16 by using a cleaning blade arm. The fur brush 103 and the cleaning blade 104 are attached to or separated from the surface of the intermediate transfer belt 16 by rotation of the cleaning blade arm. An attached position of the cleaning unit 102 is indicated by a solid line in FIG. 10, and a separated position of the cleaning unit is indicated by a two-dot chain line in FIG. 10. FIG. 11 shows the separated position of the cleaning unit 102 in the image forming apparatus of FIG. 10.

In a conventional image forming apparatus, the collected toner in the toner case of the cleaning unit may erroneously scatter away from the toner case due to vibrations of the attaching/separating movements of the cleaning unit.

In the image forming apparatus of FIG. 10, the cleaning unit 102 is provided adjacent to the belt pulley 14 of the intermediate transfer belt 16 in order to save internal space, and it is necessary that the cleaning unit 102 be located near the vacuum unit 100. When the cleaning unit 102 is separated from the intermediate transfer belt 16, the collected toner in the cleaning unit 102 is more likely to scatter away from the toner case of the cleaning unit 102 due to the actuating pressure of the vacuum unit 100.

Figure 12:
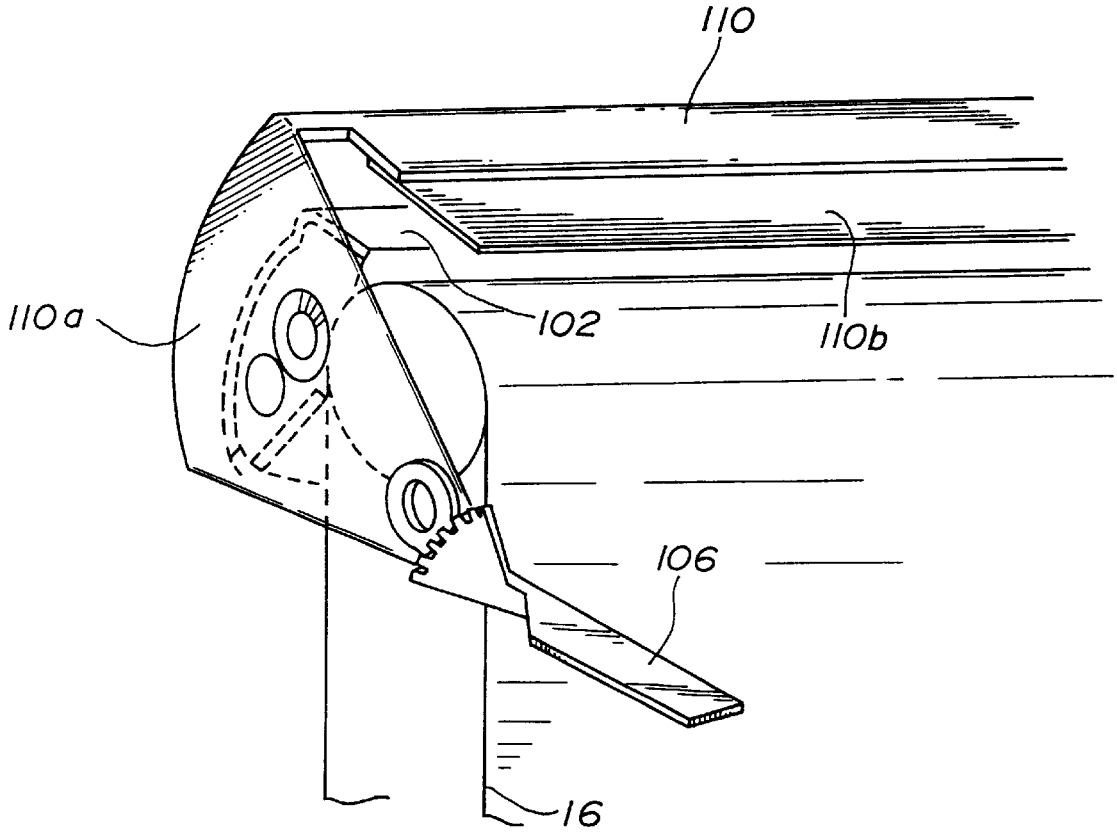
FIG. 12 is a diagram for explaining a retracted position of the protection unit in the image forming apparatus of FIG. 10.

FIG. 12 shows a retracted position of the protection unit 110 in the image forming apparatus of FIG. 10. The protection unit 110 in the present embodiment is designed to eliminate the above problem of the cleaning unit 102, which will be described below.

As shown in FIG. 10 and FIG. 11, the protection unit 110 includes a main part 110*a*. The main part 110*a* is essentially the same as the protection unit 1 of FIG. 7. The main part 110*a* of the protection unit 110 generally has the circular curved cover plate portion, the side walls at both ends of the cover plate portion, and the pins outwardly extending from the side walls. The protection unit 110 has the overall length that is larger than the overall width of the intermediate transfer belt 16. The cover plate portion of the protection unit 110 has a curved surface whose cross section matches with the circular arc of the side walls, and the protection unit 110 fully covers the overall width of the image transfer area of the intermediate transfer belt 16.

The pins of the protection unit 110 are fitted to the process unit case 5 such that the protection unit 110 is rotatably supported on the process unit case 5. The protection unit 110 is rotatable around the pins between the active position and the retracted position similar to the protection unit 1 of FIG. 7. The side walls of the protection unit 110 are provided in the shape of a segment of a circle, and the pins are located at the center of the segment of the circle of the side walls.

The protection unit 110 has no driven gear like the driven gear 51 of FIG. 5 but includes a driven gear which is similar to the driven gear 54 of FIG. 7. The driven gear of the protection unit 110 is provided on the pin of one of the side walls such that the driven gear and the protection unit 110 are together rotatable around the pin.

The protection unit 110 is provided with a sector gear which is rotatably supported on the process unit case 5. The sector gear is engaged with the driven gear of the protection unit 110. The sector gear is rotatable around a pin of an operation lever 106, and the position of the sector gear relative to the process unit case 5 is fixed. In the present embodiment, the sector gear is provided in the shape of a segment of a circle, and the sector gear has a toothed portion along the circular arc of the segment of the circle.

The operation lever 106 is fixed to the sector gear at the pin of the operation lever 106 (or at the center of the rotation of the sector gear) such that the operation lever 106 and the sector gear are together rotatable around the pin. The operation lever 106 outwardly extends from the pin in a direction opposite to the toothed portion of the sector gear.

Similar to the embodiment of FIG. 7, the protection unit 110 includes a tension spring which is connected at one end to the sector gear and connected at the other end to the process unit case 5. The tension spring exerts an actuating force on the sector gear so as to rotate the sector gear around the pin of the operator lever 106. The sector gear is engaged with the driven gear of the protection unit 110, and the protection unit 110 is pulled toward the active position by the actuating force of the tension spring through the engagement of the sector gear and the driven gear.

When the open/close frame 3 is set at the closed position in the image forming apparatus of FIG. 10, the pressing pin of the open/close frame 3 is connected to the operation lever 106 such that the operation lever 106 is held at a position shown in FIG. 12. In this condition, the protection unit 110 is set at the retracted position against the actuating force of the tension spring by the connection of the open/close frame 3 and the operation lever 106. Similar to the embodiment of FIG. 7, the protection unit 110, when it is set at the retracted position, does not restrain the operation of the intermediate transfer belt 16.

As shown in FIG. 12, when the protection unit 110 is set at the retracted position away from the second transfer position S2, the main part 110*a* of the protection unit 110 fully covers the rear surface of the cleaning unit 102. The cleaning unit 102 is provided at the downstream position of the second transfer position S2. As described above, the cover plate portion of the protection unit 110 is circularly curved, and the protection unit 110, when it is set at the retracted position, fully covers the rear surface of the cleaning unit 102 in which the fur brush 103 and the cleaning blade 104 are provided. Hence, the protection unit 110 functions to reduce the influences on the cleaning unit 102 by the actuating pressure of the vacuum unit 100, and the protection unit 110 prevents the scattering of the toner from the cleaning unit 102 to the inside of the image forming apparatus. According to the protection unit 110 of FIG. 12, it is possible to effectively prevent the scattering of the toner from the cleaning unit 102 to the inside of the image forming apparatus by using a simple structure with no need for a special unit for the prevention of the scattering of the toner.

Further, as shown in FIG. 12, the protection unit 110 includes a cover sheet member 110*b*. The cover sheet member 110*b* is attached to an end of the main part 110*a* which is nearest to the sheet transport path when the protection unit 110 is at the retracted position. The sheet member 110*b* is made of a resin material or a rubber material, and has a small thickness and some elasticity. The sheet member 110*b* may be fixed to the main part 110*a* by using an adhesive agent, press fitting or fastening screws. The sheet member 110*b* extends from the end of the main part 110*a* toward the second transfer position S2 of the intermediate transfer belt 16. The sheet member 110*b* of the protection unit 110 fully covers the side of the cleaning unit 102 confronting the vacuum unit 100 so as to effectively reduce the influences on the cleaning unit 102 by the actuating pressure of the vacuum unit 100.

According to the protection unit 110 of FIG. 12, it is possible to more effectively prevent the scattering of the toner from the cleaning unit 102 to the inside of the image forming apparatus. Alternatively, a preferred embodiment of the protection unit 110 may be configured such that the main part 110*a* and the sheet member 110*b* are integrally formed by molding and a portion corresponding to the sheet member 110*b* is formed with a small thickness.

Further, in the above-described protection unit 110, the cover plate portion has the curved surface whose cross section matches with the circular arc of the side walls of the protection unit 110. The curved surface of the protection unit 110 is in conformity with the outer periphery of the intermediate transfer belt 16 which is wound on the belt pulley 14. When the protection unit 110 is set at one of the retracted position and the active position, and during the rotation of the protection unit 110 between the retracted position and the active position, the protection unit 110 requires only a small internal space along the outer periphery of the intermediate transfer belt 16. The configuration of the protection unit 110 is useful to provide a small-size image forming apparatus and save an internal space for the protection unit in the image forming apparatus.

Figure 13:
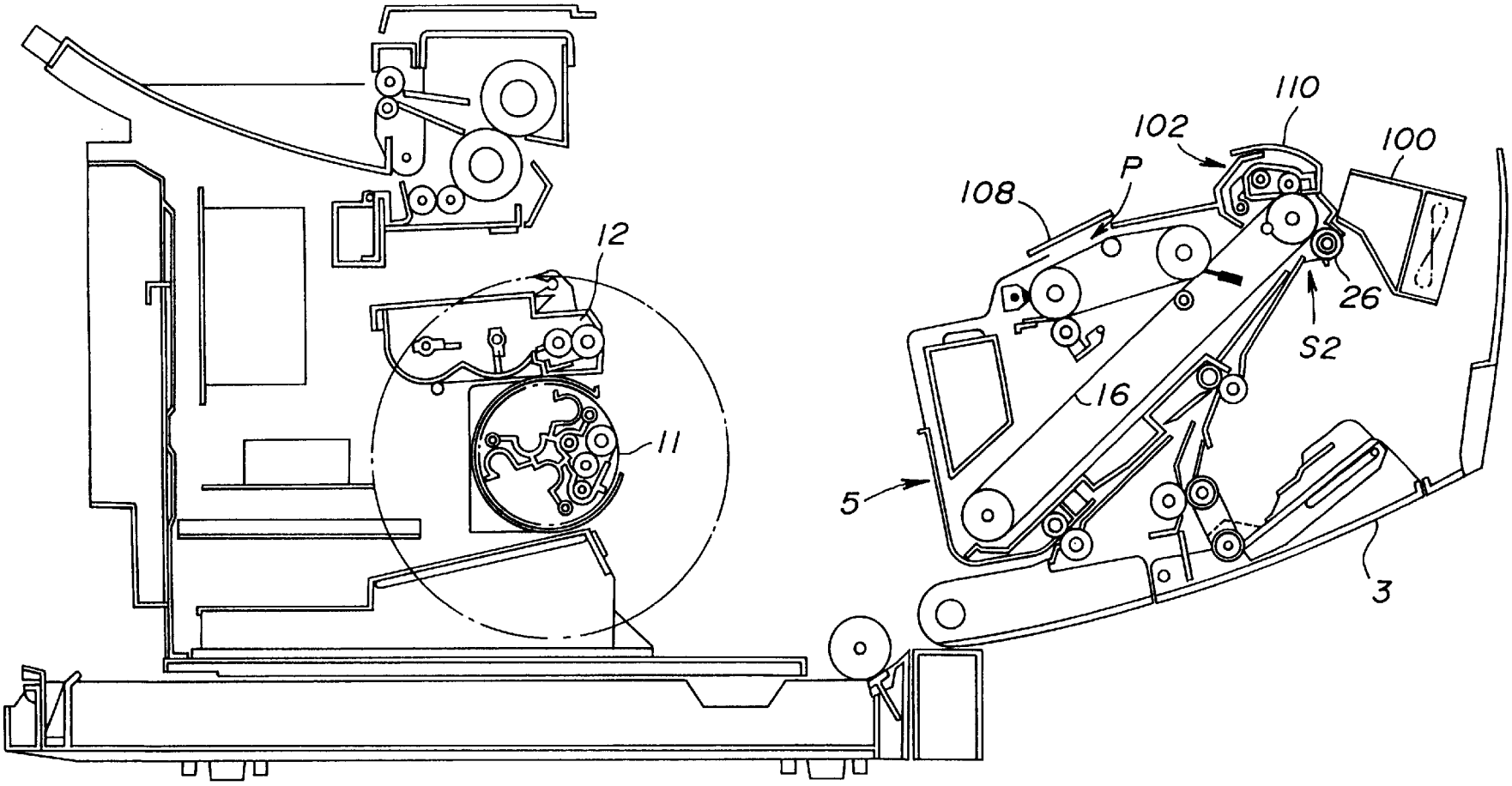
FIG. 13 is a diagram for explaining a condition of the image forming apparatus of FIG. 10 in which the process unit is set at the open position and the open/close frame is set at the open position.

FIG. 13 shows a condition of the image forming apparatus of FIG. 10 in which the process unit case 5 is set at the open position and the open/close frame 3 is set at the open position.

As shown in FIG. 13, when the open/close frame 3 and the process unit case 5 are set at the open positions, the multicolor developing unit 11 and the black developing unit 12 are placed in the exposed condition.

When the process unit case 5 is set at the open position as shown in FIG. 13, the open/close frame 3 and the process unit case 5 are connected to each other, so that the pressing pin of the open/close frame 3 is connected to the operation lever 106. In this condition, the protection unit 110 is set at the retracted position away from the second transfer position S2, and the protection unit 110 fully covers the rear surface of the cleaning unit 102.

When the multicolor developing unit 11 or the black developing unit 12 needs replacement or repair, the operator can easily change it by a new one by setting both the open/close frame 3 and the process unit case 5 at the open positions. The rear surface of the cleaning unit 102 which is subject to the toner or the like is protected by the protection unit 110, and it is possible for the image forming apparatus of the present embodiment to provide a good operability for the replacement or the repair of the operator.

In addition, when the open/close frame 3 and the process unit case 5 are set at the open positions as shown in FIG. 13, the second transfer position S2 of the intermediate transfer belt 16 is covered by the open/close frame 3 and it is not placed in the exposed condition.

In the process unit case 5, the photoconductive medium 8 and the intermediate transfer belt 16 are provided integrally with the process unit case 5. Both the photoconductive medium 8 and the intermediate transfer belt 16 in the process unit case 5 can be changed by a new process unit case when they need replacement or repair. In the process unit case 5, a shielding member 108 is provided at a contact region "P" (indicated by the arrow in FIG. 13) of the process unit case 5 between the photoconductive medium 8 and the developing units 11 and 12. The contact region P of the process unit case 5 is placed in an exposed condition when the process unit case 5 is set at the open position as shown in FIG. 13. Hence, when the process unit case 5 is set at the open position, there is a possibility that the operator erroneously touches the contact region P during the replacement or the repair.

The shielding member 108 is movably attached to the process unit case 5, and the shielding member 108 is provided to be movable, relative to the contact region P of the process unit case 5, between an active position (shown in FIG. 13) and a retracted position (not shown). When the process unit case 5 is set at the open position as shown in FIG. 13, the shielding member 108 is moved to the active position so that the shielding member 108 protects or covers the contact region P of the process unit case 5 so as to prevent the contact region P from being erroneously touched by the operator. When the process unit case 5 is set at the closed position, the shielding member 100 is moved to the retracted position, so that the shielding member 108 does not restrain an operation of the photoconductive medium 8 in the image forming apparatus. In this regard, the configuration of the protection unit 110 may be applied to the shielding member 108.

The contact region P of the process unit case 5 which is subject to the toner or the like is protected by the shielding member 108, and it is possible for the image forming apparatus of the present embodiment to provide a good operability for the replacement or the repair of the operator.

Figure 14:
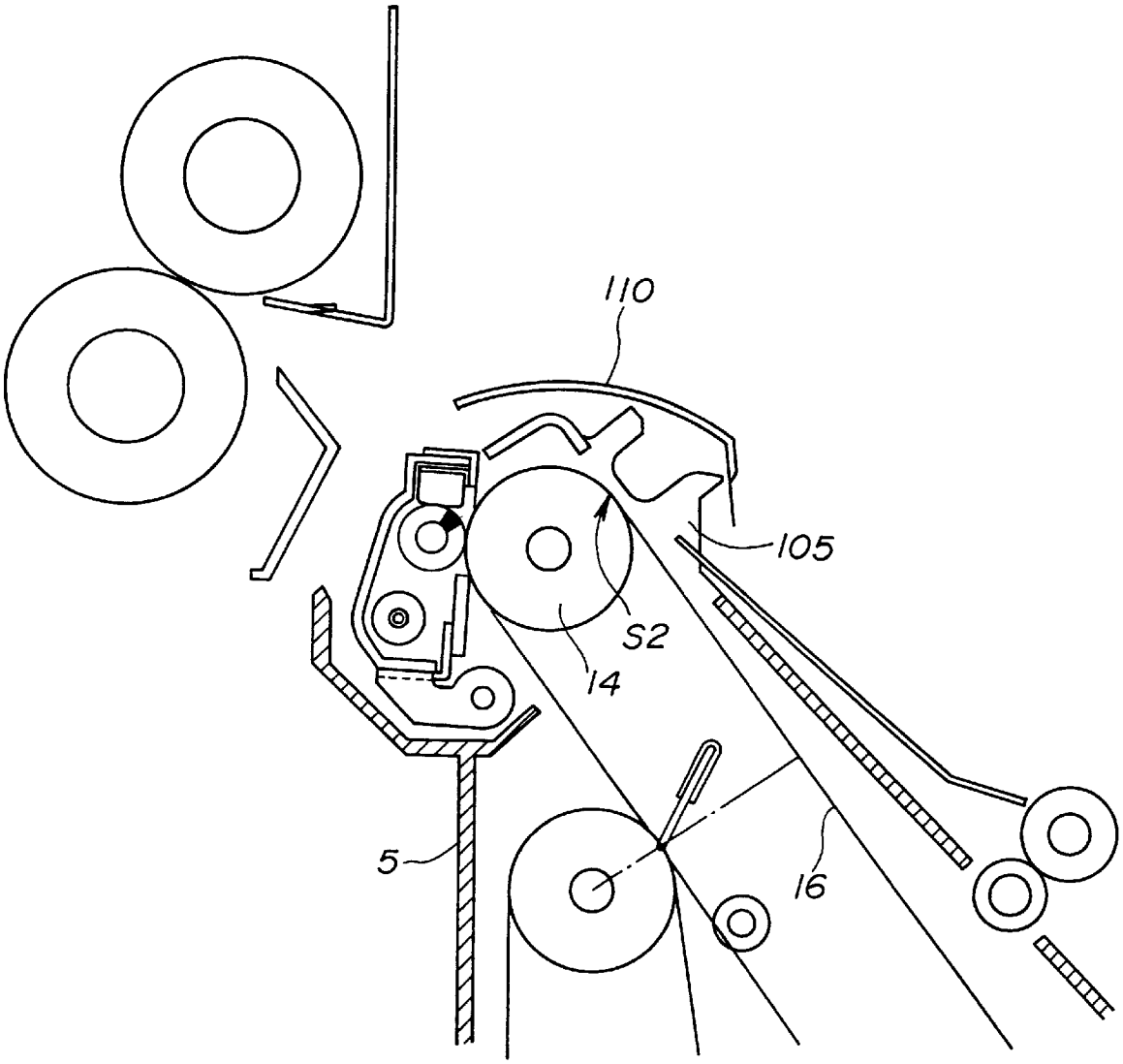
FIG. 14 is a diagram for explaining a further example of the protection unit in the image forming apparatus of the present invention.

FIG. 14 shows a further example of the protection unit 110 in the image forming apparatus of the present invention. In FIG. 14, the vacuum unit 100 of the open/close frame 3 and the transfer roller 26 of the process unit case 5 are omitted, for the sake of convenience.

In the process unit case 5 of FIG. 14, a positioning member 105 is provided, at the second transfer position S2 of the intermediate transfer belt 16, on both sides of the process unit case 5. The positioning members 105 may be fixed to the sides of the process unit case 5 by using an adhesive agent, press fitting or fastening screws. The positioning members 105 are useful to allow the transfer roller 26 to be positioned at the second transfer position S2 of the intermediate transfer belt 16 during operation of the image forming apparatus. Alternatively, a preferred embodiment of the positioning members 105 may be configured such that the positioning members 105 and the process unit case 5 are integrally formed by molding.

In the image forming apparatus of the present embodiment, the transfer roller 26 is brought into contact with the positioning members 105 at the sides of the process unit case 5 such that the transfer roller 26 is positioned at the second transfer position S2. The connection of the transfer roller 26 and the positioning members 105 is an important factor to determine the second transfer pressure of the transfer roller 26 on the intermediate transfer roller 16 at the second transfer position P2 as well as the nip width of the belt 16 and the roller 26 in contact.

In a modification of the positioning members 105 of the present embodiment, the positioning members 105 may be provided on the open/close frame 3 or the main frame 2 as a separate part of the process unit case 5. However, in order to accurately position the transfer roller 26 at the second transfer position S2, it is preferred that the positioning members 105 be provided on the sides of the process unit case 5. The intermediate transfer belt 16 is provided in the process unit case 5, and the belt pulley 14 for rotating the intermediate transfer belt 16 is supported on the process unit case 5.

In the image forming apparatus of the present embodiment, the process unit 4 in which the plurality of image forming elements are incorporated is accommodated in the process unit case 5, and the process unit case 5 is removably attached to the main frame 2. When the process unit case 5 is set at the open position, the operator can easily remove the process unit case 5 from the main frame 2 by lifting the process unit case 5, or can easily insert the process unit case 5 (or a new process unit case) in the main frame 2. Since the positioning members 105 in the present embodiment are provided on the process unit case 5, the positioning members 105 may be deformed or damaged when removing or inserting the process unit case 5. As described above, the relative positions of the positioning members 105 to the process unit case 5 require a high accuracy. If the positioning members 105 are deformed or damaged, the affected positioning members 105 do not provide accurate positioning of the transfer roller 26 at the second transfer position S2 of the intermediate transfer belt 16. In such a case, the process unit case 5 including the positioning members 105 or the positioning members 105 need a further replacement or repair.

As shown in FIG. 14, the protection unit 110 in the present embodiment is movably attached to the process unit case 5, and the protection unit 110 is provided to be movable, relative to the positioning members 105, between an active position (shown in FIG. 14) and a retracted position (not shown). When the open/close frame 3 is set at the open position (not shown), the protection unit 110 is moved to the active position (shown in FIG. 14) so that the protection unit 110 protects or covers the positioning members 105 of the process unit case 5 so as to prevent the positioning member 105 from being deformed or damaged. When the open/close frame 3 is set at the closed position, the protection unit 110 is moved to the retracted position (not shown), so that the protection unit 110 does not restrain an operation of the process unit 4 in the image forming apparatus. In this regard, the configuration of the protection unit 110 shown in FIG. 10 may be applied to the protection unit 110 of the present embodiment.

In the present embodiment, the positioning members 105 which are subject to damage or deformation are protected by the protection unit 110, and it is possible for the image forming apparatus of the present embodiment to provide a good operability for the replacement of the operator and safely prevent the positioning members 105 from the damage or deformation during the replacement.

Further, the present invention is not limited to the above-described embodiments, and variations and modifications may be made without departing from the scope of the present invention. For example, the configuration of the protection unit and the mechanism for moving the protection unit are not limited to the above-described embodiments. The protection unit of the present invention and the mechanism for moving the protection unit of the present invention may be embodied to have a configuration that allows the protection unit to protect or shield the second transfer position of the intermediate transfer belt, allows the protection unit to protect or cover the cleaning unit, or allows the protection unit to protect the positioning members for positioning the transfer roller.

Further, it is not necessarily required for the protection unit of the present invention to protect or cover the entire area of the second transfer position of the intermediate transfer belt which is exposed when the open/close member is set at the open position. It is adequate for the protection unit of the present invention to prevent the second transfer position in the exposed condition from being erroneously touched by the operator. The protection unit of the present invention may be embodied to protect partially the second transfer position but prevent the operator from touching the exposed second transfer position.

What is claimed is:

1. An image forming apparatus comprising:

a first image support for supporting a toner image on the first image support;

a second image support for supporting the toner image, transferred from the first image support, on the second image support;

a transfer unit for transferring the toner image on the second image support to a recording sheet at a transfer position where the recording sheet is brought into contact with the second image support by the transfer unit;

a rotating member for rotating the second image support around a central axis of the rotating member, the rotating member supporting the rotation of the second image support at the transfer position where the toner image is transferred from the second image support to the recording sheet;

a fixing unit having a pair of rollers for fixing the toner image to the recording sheet when the pair of rollers contact the recording sheet after the toner image is transferred to the recording sheet;

an open/close member provided to be movable between an open position and a closed position, wherein a portion of the image forming apparatus is exposed when the open/close member is set at the open position, said portion including at least the transfer position on the second image support; and a protection unit provided to be movable between an active position and a retracted position in accordance with a movement of the open/close member, the protection unit being moved to the active position when the open/close member is set at the open position, so as to substantially cover the transfer position on the second image support with the protection unit, and the protection unit being moved to the retracted position when the open/close member is set at the closed position, so as not to restrain an operation of the second image support, wherein the retracted position of the protection unit is determined by a position where a portion of the protection unit, nearest to a transport path of the recording sheet when the protection unit is at the retracted position, is located below a line between a central contact point of the second image support and the transfer unit and a central contact point of the pair of rollers of the fixing unit, and above a line between a central point of the rotating axis of the rotating member and the central contact point of the pair of rollers of the fixing unit.

2. The image forming apparatus according to claim 1, wherein, after the toner image is transferred from the second image support to the recording sheet, the recording sheet with the toner image on a back side of the recording sheet is transported to the fixing unit.

3. The image forming apparatus according to claim 2, further comprising a vacuum unit provided above the transport path of the recording sheet between the transfer unit and the fixing unit, the vacuum unit producing an actuating pressure to pull the recording sheet passing through the transport path.

4. The image forming apparatus according to claim 3, wherein a first transport speed of the recording sheet at the transfer position and a second transport speed of the recording sheet at the fixing unit are determined such that the first transport speed is greater than the second transport speed, and wherein the vacuum unit places the recording sheet in the form of an upwardly curved loop when passing through the transport path.

5. The image forming apparatus according to claim 1, wherein the protection unit includes an elastic sheet member attached to an end of the protection unit nearer to the transport path when the protection unit is at the retracted position.

6. An image forming apparatus comprising:

a first image support for supporting a toner image on the first image support;

a second image support for supporting the toner image, transferred from the first image support, on the second image support, the second image support provided to be rotatable;

a transfer unit for transferring the toner image on the second image support to a recording sheet at a transfer position where the recording sheet is brought into contact with the second image support by the transfer unit;

a cleaning unit provided at a downstream position of the transfer unit with respect to a direction of rotation of the second image support, the cleaning unit removing a toner from the second image support;

an open/close member provided to be movable between an open position and a closed position, wherein a portion of the image forming apparatus is exposed when the open/close member is set at the open position, said portion including at least the transfer position on the second image support; and a protection unit provided to be movable between an active position and a retracted position in accordance with a movement of the open/close member, the protection unit being moved to the active position when the open/close member is set at the open position, so as to substantially cover the transfer position on the second image support with the protection unit, and the protection unit being moved to the retracted position when the open/close member is set at the closed position, so as not to restrain an operation of the second image support, wherein, when the protection unit is at the retracted position, the protection unit substantially covers a rear surface of the cleaning unit.

7. The image forming apparatus according to claim 6, wherein the image forming apparatus includes a supporting member provided to support the cleaning unit such that during the rotation of the second image support the second image support is fastened at the transfer position between the transfer unit and the supporting member, and fastened between the cleaning unit and the supporting member at the downstream position which confronts the transfer position.

8. The image forming apparatus according to claim 7, wherein the second image support is provided in the form of an intermediate transfer belt, and the supporting member is a rotating member for rotating the second image support around a central axis of the rotating member, the rotating member supporting the rotation of the second image support at the transfer position.

9. The image forming apparatus according to claim 6, wherein the protection unit includes an elastic sheet member attached to an end of the protection unit nearer to a transport path of the recording sheet when the protection unit is at the retracted position.

10. The image forming apparatus according to claim 9, further comprising a vacuum unit provided above the transport path of the recording sheet between the transfer unit and the fixing unit, the vacuum unit producing an actuating pressure to pull the recording sheet passing through the transport path.

11. The image forming apparatus according to claim 6, wherein the cleaning unit is provided to be movable to the second image support between a first position where the cleaning unit is attached to the second image support and a second position where the cleaning unit is separated from the second image support.

12. A process unit for use in an image forming apparatus, the image forming apparatus having an open/close member provided to be movable between an open position and a closed position, the process unit comprising:

an intermediate image support for supporting a toner image, transferred from a photoconductive medium, on the intermediate image support, the intermediate image support provided to be rotatable;

a transfer unit for transferring the toner image on the intermediate image support to a recording sheet at a transfer position where the recording sheet is brought into contact with the intermediate image support by the transfer unit, wherein at least the transfer position on the intermediate image support is exposed when the open/close member is set at the open position;

a cleaning unit provided at a downstream position of the transfer unit with respect to a direction of rotation of the intermediate image support, the cleaning unit removing a toner from the intermediate image support; and a protection unit provided to be movable between an active position and a retracted position in accordance with a movement of the open/close member, the protection unit being moved to the active position when the open/close member is set at the open position, so as to substantially cover the transfer position on the intermediate image support with the protection unit, and the protection unit being moved to the retracted position when the open/close member is set at the closed position, so as not to restrain an operation of the intermediate image support, wherein, when the protection unit is at the retracted position, the protection unit substantially covers a rear surface of the cleaning unit.

13. The process unit according to claim 12, wherein the process unit is provided in the image forming apparatus such that the process unit is detachable from the image forming apparatus when the open/close member is set at the open position.

14. An image forming apparatus comprising:

a first image support for supporting a toner image on the first image support;

a second image support for supporting the toner image, transferred from the first image support, on the second image support;

a transfer unit for transferring the toner image on the second image support to a recording sheet at a transfer position where the recording sheet is brought into contact with the second image support by the transfer unit;

a positioning member for positioning the transfer unit to the second image support at the transfer position;

an open/close member provided to be movable between an open position and a closed position, wherein a portion of the image forming apparatus is exposed when the open/close member is set at the open position, said portion including at least the transfer position on the second image support; and a protection unit provided to be movable between an active position and a retracted position in accordance with a movement of the open/close member, the protection unit being moved to the active position when the open/close member is set at the open position, so as to substantially cover the transfer position on the second image support with the protection unit, and the protection unit being moved to the retracted position when the open/close member is set at the closed position, so as not to restrain an operation of the second image support, wherein, when the protection unit is at the active position, the protection unit substantially covers the positioning member.

15. The image forming apparatus according to claim 14, wherein the transfer unit is provided on the open/close member.

16. The image forming apparatus according to claim 14, wherein, when the open/close member is set at the closed position, the protection unit is moved to the retracted position and the transfer unit is brought into contact with the position member at the transfer position.

17. The image forming apparatus according to claim 14, wherein the second image support, the protection unit and the positioning member are integrally incorporated in a process unit case.

18. A process unit for use in an image forming apparatus, the image forming apparatus having an open/close member provided to be movable between an open position and a closed position, the process unit comprising:

an intermediate image support for supporting a toner image, transferred from a photoconductive medium, on the intermediate image support, the intermediate image support provided to be rotatable;

a transfer unit for transferring the toner image on the intermediate image support to a recording sheet at a transfer position where the recording sheet is brought into contact with the intermediate image support by the transfer unit, wherein at least the transfer position on the intermediate image support is exposed when the open/close member is set at the open position;

a positioning member for positioning the transfer unit to the intermediate image support at the transfer position; and a protection unit provided to be movable between an active position and a retracted position in accordance with a movement of the open/close member, the protection unit being moved to the active position when the open/close member is set at the open position, so as to substantially cover both the transfer position on the intermediate image support and the positioning member with the protection unit, and the protection unit being moved to the retracted position when the open/close member is set at the closed position, so as not to restrain an operation of the intermediate image support.

19. The image forming apparatus according to claim 18, wherein the process unit is provided in the image forming apparatus such that the process unit is detachable from the image forming apparatus when the open/close member is set at the open position.

* * * * *

UNITED STATES PATENT AND TRADEMARK OFFICE

CERTIFICATE OF CORRECTION

PATENT NO. : 5,991,570
DATED : November 23,1999
INVENTOR(S) : Hiroyoshi Haga, et al.

It is certified that error appears in the above-identified patent and that said Letters Patent is hereby corrected as shown below:

Title page,
Item [30], the Foreign Application Priority Data is incorrect. It should read as follows:

[30] Foreign Application Priority Data

| | | | |
|---|---|---|---|
| Jul. 18, 1997 | [JP] | Japan | 9-209900 |
| Jul. 10, 1998 | [JP] | Japan | 10-211994 |

Signed and Sealed this

Twenty-first Day of August, 2001

*Attest:*

Nicholas P. Godici

*Attesting Officer*

NICHOLAS P. GODICI
*Acting Director of the United States Patent and Trademark Office*